US006388631B1

(12) United States Patent
Livingston et al.

(10) Patent No.: US 6,388,631 B1
(45) Date of Patent: May 14, 2002

(54) RECONFIGURABLE INTERLEAVED PHASED ARRAY ANTENNA

(75) Inventors: Stan W. Livingston, Fullerton; Jar J. Lee, Irvine; James H. Schaffner, Chatsworth; Robert Y. Loo, Agoura Hills, all of CA (US)

(73) Assignees: HRL Laboratories LLC, Malibu, CA (US); Raytheon Company, Lexington, MA (US)

( * ) Notice: Subject to any disclaimer, the term of this patent is extended or adjusted under 35 U.S.C. 154(b) by 0 days.

(21) Appl. No.: 09/811,934

(22) Filed: Mar. 19, 2001

(51) Int. Cl.[7] ..... H01Q 13/10

(52) U.S. Cl. ..... 343/767; 343/770; 343/872; 342/374

(58) Field of Search ..... 343/767, 770, 343/853, 771, 876, 872; 342/373, 374, 375

(56) References Cited

U.S. PATENT DOCUMENTS 5,189,433 A * 2/1993 Stern et al. ..... 343/770
6,169,518 B1 * 1/2001 Nelson et al. ..... 342/373

* cited by examiner

*Primary Examiner*—Tan Ho
(74) *Attorney, Agent, or Firm*—Ladas & Parry

(57) ABSTRACT

A reconfigurable wide band phased array antenna for generating multiple antenna beams for multiple transmit and receive functions. The antenna array comprises multiple long non-resonant TEM slot antenna apertures with RF MEMS switches disposed within the slots. The RF MEMS switches are positioned directly within the feed lines across the slots to directly control the coupling of RF energy to the slots. Multiple RF MEMS switches are used within each slot, which allows multiple transmit/receive functions and/or multiple frequencies to be supported by each slot. The frequency coverage provided by the slot antenna has a greater than 10:1 frequency range.

36 Claims, 16 Drawing Sheets

Transmit Efficiency @ Borsite
(Includes Mutual Coupling, Radome and Backplane reflection)

RECONFIGURABLE INTERLEAVED PHASED ARRAY ANTENNA

STATEMENT OF GOVERNMENT INTEREST

This invention was made with government support under Contract No. N660199-C-8635 awarded by DARPA. The government has certain rights in this invention.

FIELD OF THE INVENTION

The present invention relates generally to phased array antennas and, more specifically, to reconfigurable wideband phased array antennas capable of generating multiple beams for multiple functions.

BACKGROUND OF THE INVENTION

Defense and commercial electronic systems such as radar surveillance, terrestrial and satellite communications, navigation, identification, and electronic counter measures are often deployed on a single structure such as a ship, aircraft, satellite or building. These systems usually operate at different frequency bands in the electromagnetic spectrum. To support multiple band, multiple function operations, several single discrete antennas are usually installed on separate antenna platforms, which often compete for space on the structure that carries them. Additional antenna platforms add extra weight, occupy volume, and can cause electromagnetic compatibility, radar cross section, and observation problems.

There is a need to operate antenna apertures at close proximity to each other at different frequencies and with different functions, without detrimentally affecting antenna operation. It is often desired to have multiple band, wide scan, and multiple channel capabilities in a single platform. A typical architecture for providing multiple band, multiple function capabilities in a single platform is shown in FIG. 1. The antenna platform 100 comprises multiple antenna cells $\mathbf{110}_{A \ldots N}$, where each cell consists of a radiating element $\mathbf{116}_{A \ldots N}$, a transmission line $\mathbf{114}_{A \ldots N}$ that couples RF energy to the radiating element $\mathbf{116}_{A \ldots N}$, and a radiating control element $\mathbf{112}_{A \ldots N}$, such as a phase shifter, transmit and receive (T/R) module, or other devices that control the RF energy radiated from each radiating element $\mathbf{116}_{A \ldots N}$. Each antenna cell $\mathbf{110}_{A \ldots N}$ is coupled to a separate transmit or receive function $\mathbf{10}_{A \ldots N}$. Each transmit or receive function $\mathbf{10}_{A \ldots N}$ is an independent process of amplitude, phase, and/or frequency. For example, one function may the transmission of a satellite communication signal at 2 GHz, while another function may be the receipt of a radar signal at 10 GHz. The antenna platform 100 may comprise a planar array that contains several of the antenna cells $\mathbf{10}_{A \ldots N}$ latticed in two dimensions, with each cell $\mathbf{110}_{A \ldots N}$ acting collectively to produce a far field beam related to the overall desired functional properties.

An antenna platform may use a different density of antenna cells occupying the same lattice space for different transmit or receive functions. For example, a high frequency function, such as a radar operating at 10 GHz, may use several antenna cells to provide for precision beam steering, while a low frequency function, such as a communication channel operating at 2 GHz, may use fewer antenna cells due to its lower wavelength. The use of different densities of antenna cells for different functions is sometimes referred to as array thinning. Each transmit or receive function may require a unique lattice spacing to optimize radiation performance, such as to provide grating lobe free scanning, or to optimize beam width synthesis. At lower frequencies, phase control over fewer radiating elements is required to achieve grating lobe free scanning, since only elements spaced more than a half wavelength apart must be controlled.

FIG. 2 illustrates a planar array 200 where different densities of antenna cells $\mathbf{210}_A$, $\mathbf{210}_B$, $\mathbf{210}_C$ are used for three different antenna functions, $\mathbf{10}_A$, $\mathbf{10}_B$, $\mathbf{10}_C$. In FIG. 2, a specific area of the planar array 200, a first function $\mathbf{10}_A$ uses four antenna cells $\mathbf{210}_A$, while a second function $\mathbf{10}_B$ uses only two radiating elements $\mathbf{210}_B$, while a third function $\mathbf{10}_C$ uses only a single antenna cell $\mathbf{210}_C$. Each antenna cell $\mathbf{210}_A$, $\mathbf{210}_B$, $\mathbf{210}_C$ still contains a radiating element $\mathbf{216}_A$, $\mathbf{216}_B$, $\mathbf{216}_C$, a transmission line $\mathbf{214}_A$, $\mathbf{214}_B$, $\mathbf{214}_C$, and a radiating control element $\mathbf{212}_A$, $\mathbf{212}_B$, $\mathbf{212}_C$.

Note that thinning the array reduces the number of elements required in the planar array. For example, if a planar array uses sixteen antenna cells for each function, and the array services three functions, a total of forty-eight antenna cells are required for the array. This also means that forty-eight radiating elements, transmission lines, and radiating control elements are also required. However, if the array thinning illustrated in FIG. 2 is used, fewer antenna cells and thus fewer antenna components are required. For example, in FIG. 2, if the first function $\mathbf{10}_A$ uses a total of sixteen antenna cells $\mathbf{210}_A$ to achieve the desired performance, sixteen radiating elements $\mathbf{216}_A$, transmission lines $\mathbf{214}_A$, and radiating control elements $\mathbf{212}_A$ are required. However, the second function $\mathbf{10}_B$ will require only half as many antenna cells $\mathbf{210}_B$, so it requires only eight radiating elements $\mathbf{216}_B$, transmission lines $\mathbf{214}_B$, and radiating control elements $\mathbf{212}_B$. Finally, the third function $\mathbf{10}_C$ requires one-quarter as many antenna cells $\mathbf{210}_C$ as the first function $\mathbf{10}_A$, so it requires only four radiating elements $\mathbf{216}_C$, transmission lines $\mathbf{214}_C$, and radiating control elements $\mathbf{212}_C$. Hence, the array thinning shown in FIG. 2 provides a significant reduction in the number of components.

Antenna cells of a thinned planar array can be interleaved in a single array as shown in FIG. 2. However, if the radiating elements are in close proximity to each other, the RF energy from an antenna cell supporting one function is likely to couple to another antenna cell and reduce the performance of the array. One approach to reduce the coupling of RF energy is to switch the unused cells, as shown in FIG. 3. In FIG. 3, each antenna cell $\mathbf{310}_{A,B,C}$ in the planar array 300 consists of a radiating control element $\mathbf{312}_{A,B,C}$ an RF switch $\mathbf{318}_{A,B,C}$, a transmission line $\mathbf{314}_{A,B,C}$, and a radiating element $\mathbf{316}_{A,B,C}$. However, simply disconnecting an unused cell $\mathbf{310}_{A,B,C}$ with the RF switch $\mathbf{318}_{A,B,C}$, is not desired because the finite length of open circuit transmission lines $\mathbf{314}_{A,B,C}$ tends to add spurious impedance to the array 300, or losses can occur when the switches $\mathbf{318}_{A,B,C}$ are terminated in loads.

The prior art discloses many techniques for addressing the interleaving problems discussed above without the use of switches. Provencher et al. in U.S. Pat. No. 3,623,111, Bowen et al. in U.S. Pat. No. 4,772,890, Chu et al. in U.S. Pat. No. 5,557,291, and Mott et al. in U.S. Pat. No. 5,461, 391 disclose examples of multiple band arrays that do not use switches to provide operation at multiple frequency bands. These arrays generally use radiating elements configured to radiate radio frequency energy at a specific frequency band. Dissipation of the active ports is minimized by reducing the coupling of energy into adjacent inactive radiating elements. Because the adjacent elements in an interleaved aperture can re-radiate spurious signals with an amplitude and phase varying over frequency, thus interfering with the radiation of the desired signal, the apertures within these arrays are usually cross-polarized from one another or widely spaced in frequency to avoid mutual coupling errors. However, these design choices limit the flexibility of the array.

The prior art also discloses reusing radiating elements at lower frequency bands by coupling the radiating elements with the transmit or receive function with an RF combiner 460, such as a coupler, diplexer, or switch, as shown in FIG. 4. FIG. 4 shows an antenna array 400 where three transmit or receive functions $\mathbf{10}_{A,B,C}$ are coupled to separate radiating control elements $\mathbf{420}_{A,B,C}$. However, the outputs of the radiating control elements $\mathbf{420}_{A,B,C}$ are multiplexed to the minimum number of radiating elements 440 required to support a specific function $\mathbf{10}_{A,B,C}$ by using RF combiners 460. In the example depicted in FIG. 4, one function $\mathbf{10}_{A}$ requires four radiating elements 440, so the array only contains four radiating elements 440. Hence, the antenna cell used to support a specific transmit or receive function $\mathbf{10}_{A,B,C}$ actually shares the radiating element 440 and transmission line 430 with an antenna cell used to support another transmit or receive function $\mathbf{10}_{A,B,C}$.

In an architecture where the radiating elements are shared or "reused," passive couplers tend to introduce losses, so the use of diplexers or band pass filters is preferred. Tang et al. in U.S. Pat. No. 5,087,922 disclose bandpass filters coupled to dipole elements that present open circuits or short circuits at particular operating frequencies. Lee et. al in U.S. Pat. No. 4,689,627 disclose diplexers coupled to radiating elements in an array, where the diplexers provide isolation between the two frequency bands at which the array operates. However, reusing radiating elements in this manner may require the use of extremely complex and costly multiple band diplexers and/or wideband radiating elements.

Therefore, there exists a need in the art for an antenna array that can support multiple functions over extremely large bandwidths. There exists a further need in the art for an antenna array that provides improved isolation between signals at different operating frequencies, greater efficiency, and the flexibility to operate at several frequencies.

SUMMARY OF THE INVENTION

It is an object of the present invention to provide an antenna array and method of receiving and radiating radio-frequency (RF) signals for the transmission and reception of RF signals over large bandwidths. It is a further object of the present invention to provide the capability to support multiple band, wide scan, and multiple channel capabilities in a single antenna array. It is still a further object of the present invention to provide the multiple band, wide scan, multiple channel capability in an antenna array with high array efficiency, low backscatter, low active reflection from the array, and high isolation between the multiple channels of the array.

These objects and others are provided by an antenna array which comprises multiple antenna apertures and multiple miniature switches disposed at or within the antenna apertures. The switches provide the capability to interleave and switch multiple transmit and receive functions directly at the antenna apertures. Preferably, the switches are RF MEMS switches that have the small size and channel isolation capabilities that optimally provide for switching RF signals at the antenna apertures. The antenna apertures are preferably long non-resonant TEM slots that provide the capability to operate over a 10:1 frequency range. Long non-resonant slots have lengths that generally exceed the largest operating wavelength (the lowest frequency to be radiated by the slot) and widths that are generally less than the smallest operating wavelength (the highest frequency to be radiated by the slot). Preferably, an impedance matching radome is used to match the impedance of the antenna apertures with free space to direct radiation transmission and reception to the front hemisphere of the array and to increase transmission efficiency.

In accordance with one aspect of the present invention, there is provided an array antenna for radiating RF energy comprising: a plurality of non-resonant slot apertures, each non-resonant slot aperture having a first side and a second side and an opening between the first side and the second side; a plurality of antenna feeds, one or more antenna feeds of the plurality of antenna feeds located on a first side or a second side of each non-resonant slot aperture; a plurality of switches deployed immediately adjacent to each one of the plurality of non-resonant slot apertures, each switch of the plurality of switches connected to at least one antenna feed and controllable to selectively couple RF energy from at least one antenna feed located on one side of an adjacent slot aperture across the opening of the adjacent non-resonant slot aperture to the other side of the adjacent non-resonant slot aperture. The plurality of non-resonant slot apertures may comprise openings in a metal layer, wherein each opening has a length and width to form a non-resonant slot.

In accordance with another aspect of the present invention there is provided a method of radiating and receiving RF energy with an antenna array having a smallest operating wavelength and a largest operating wavelength, the method comprising the steps of: providing a plurality of non-resonant slot apertures; providing a plurality of switches, one or more of said switches being disposed in proximity to each non-resonant slot aperture, each of said switches having a first position coupling RF energy to the aperture in proximity to the switch and having a second position isolating RF energy from the aperture in proximity to the switch; switching some of the plurality of switches to the first position; switching the remaining switches to the second position; applying RF energy to the switches.

In accordance with another aspect of the present invention, there is provided a beam-steered antenna array comprising: a plurality of non-resonant slot apertures, each non-resonant slot aperture having a first side and a second side and an opening between the first side and the second side; a plurality of groups of switches, each group of switches comprising a plurality of switches deployed immediately adjacent to the antenna apertures, the switches controllable to selectively couple RF energy at different points across the opening of each non-resonant slot aperture; a plurality of beamformers, each beamformer connected to a separate group of switches in the plurality of groups of switches; and an RF switch selectively controllable to couple RF energy to a selected one of beamformers in the plurality of beamformers. The plurality of non-resonant slot apertures may be arranged to form a planar array, wherein the slot apertures are positioned along a rectangular grid. Preferably, the slot apertures in the planar array are oriented so that the slots are generally parallel to each other.

In accordance with still another aspect of the present invention, there is provided a method of antenna beamforming, comprising the steps of: providing a plurality of non-resonant slot apertures in an antenna array; providing a plurality of groups of switches, each group of switches comprising a plurality of switches deployed at different positions immediately adjacent the non-resonant slot apertures, each of said switches having a first position coupling RF energy to the aperture in proximity to the switch and having a second position isolating RF energy from the aperture in proximity to the switch; providing a plurality of beamformers, each beamformer connected to a separate group of switches in the plurality of groups of switches; coupling RF energy to a selected one of the beamformers in the group of beamformers; switching the switches in the group of switches connected to the selected beamformer to either the first position or the second position; and switching the remaining switches to the second position. The switches from each group of switches may be disposed at the apertures at different densities, such that, for example, for every switch from a first group of switches there are four switches from a second group of switches. If the groups of switches are disposed at different densities, it is preferable that at least one switch from the group of switches disposed at higher densities is within one-tenth wavelength of the lowest operating wavelength of the slot apertures of each switch from the group of switches disposed at lower densities.

In accordance with still another aspect of the present invention, there is provided a phased array antenna system having a smallest operating wavelength and a largest operating wavelength and having multiple functions, the phased array antenna system comprising: a plurality of transmit/receive modules, each transmit/receive module being coupled to the multiple functions and having multiple channels, each channel being coupled out of the transmit/receive module at one or more transmit/receive ports; one or more non-resonant slot apertures, each slot aperture having a first side and a second side and an opening between the first side and the second side; a plurality of antenna feeds, one or more antenna feeds of the plurality of antenna feeds located on a first side or a second side of a corresponding one of the slot apertures, each antenna feed coupled to one transmit/receive port of the one or more transmit/receive ports on one transmit/receive module; and a plurality of switches deployed immediately adjacent to the non-resonant slot apertures, each switch of the plurality of switches connected to one antenna feed and controllable to selectively couple RF energy from the antenna feed located on one side of the corresponding slot aperture across the opening of the corresponding non-resonant slot aperture to the other side of the corresponding slot aperture.

The present invention provides the capability of generating multiple beams for multiple functions. This capability may be provided by controlling RF MEMS switches populated over one or more wide band non-resonant slotted apertures. An array of such apertures provides frequency and beam pointing ability for both transmit and receive functions over a wide frequency range of 10:1 or greater. In essence, the present invention provides the capability to combine multiple antennas in a single structure by switching the excitation points provided by the switches deployed at various points at the apertures. This single structure provides significant improvements in size, weight, volume, radar cross section, electromagnetic compatibility, and other antenna factors over other state-of-the-art antenna systems.

DETAILED DESCRIPTION OF PREFERRED EMBODIMENTS

Figure 1:
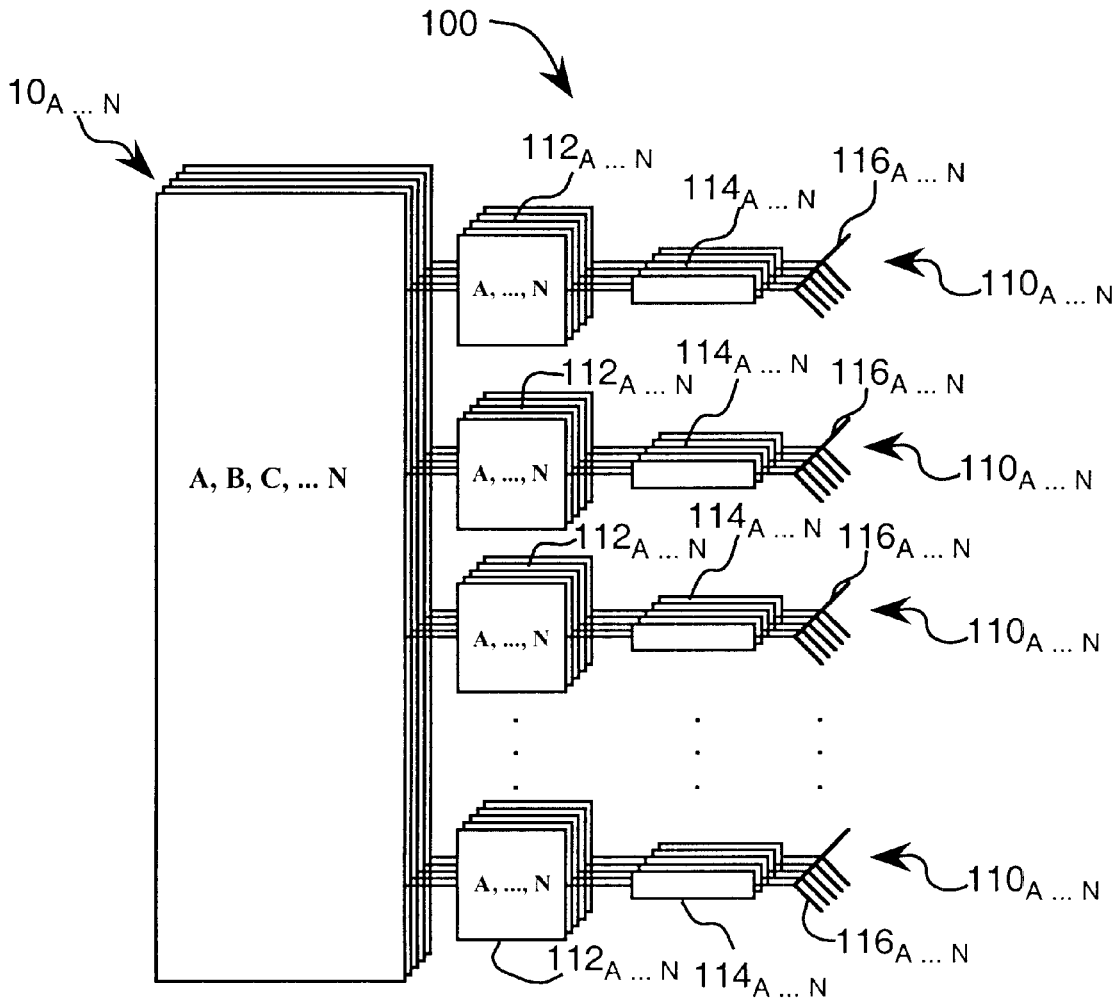
FIG. 1 (Prior Art)
FIG. 1 (prior art) shows a simplified block diagram of a multiple function, multiple band phased array antenna.
Figure 2:
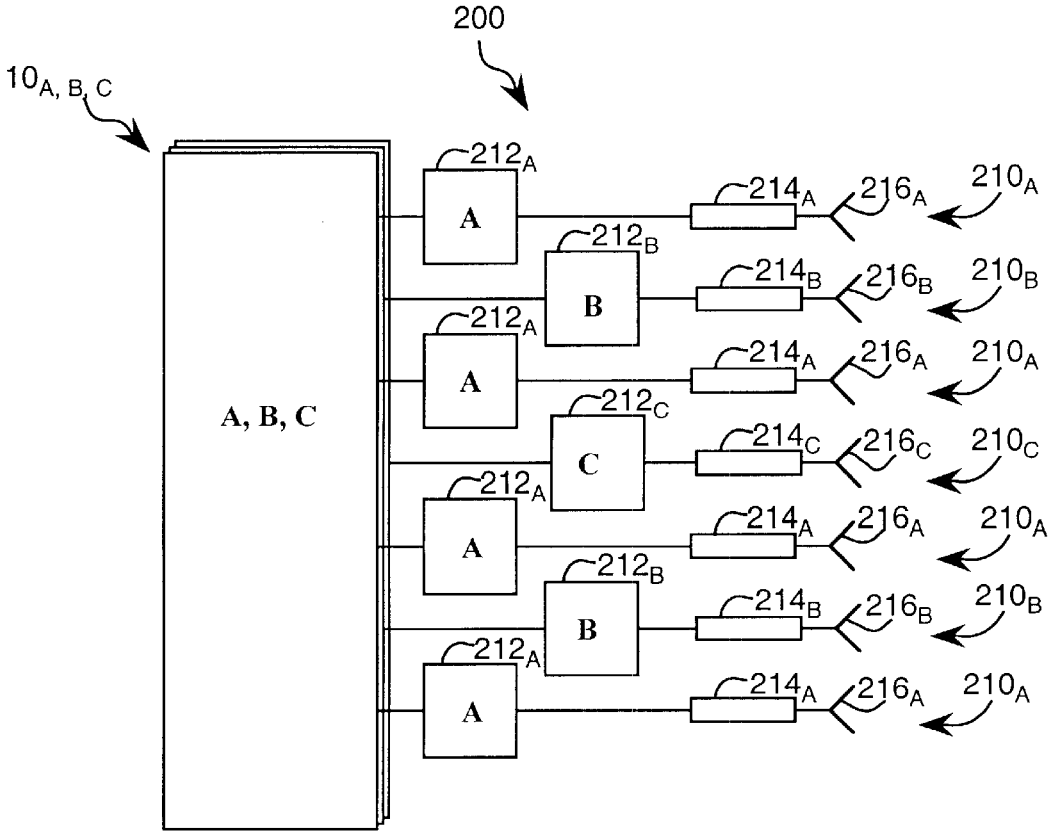
FIG. 2 (Prior Art)
FIG. 2 (prior art) shows a simplified block diagram of a multiple function, multiple band phased array antenna in which the radiating elements used for different functions have different densities.
Figure 3:
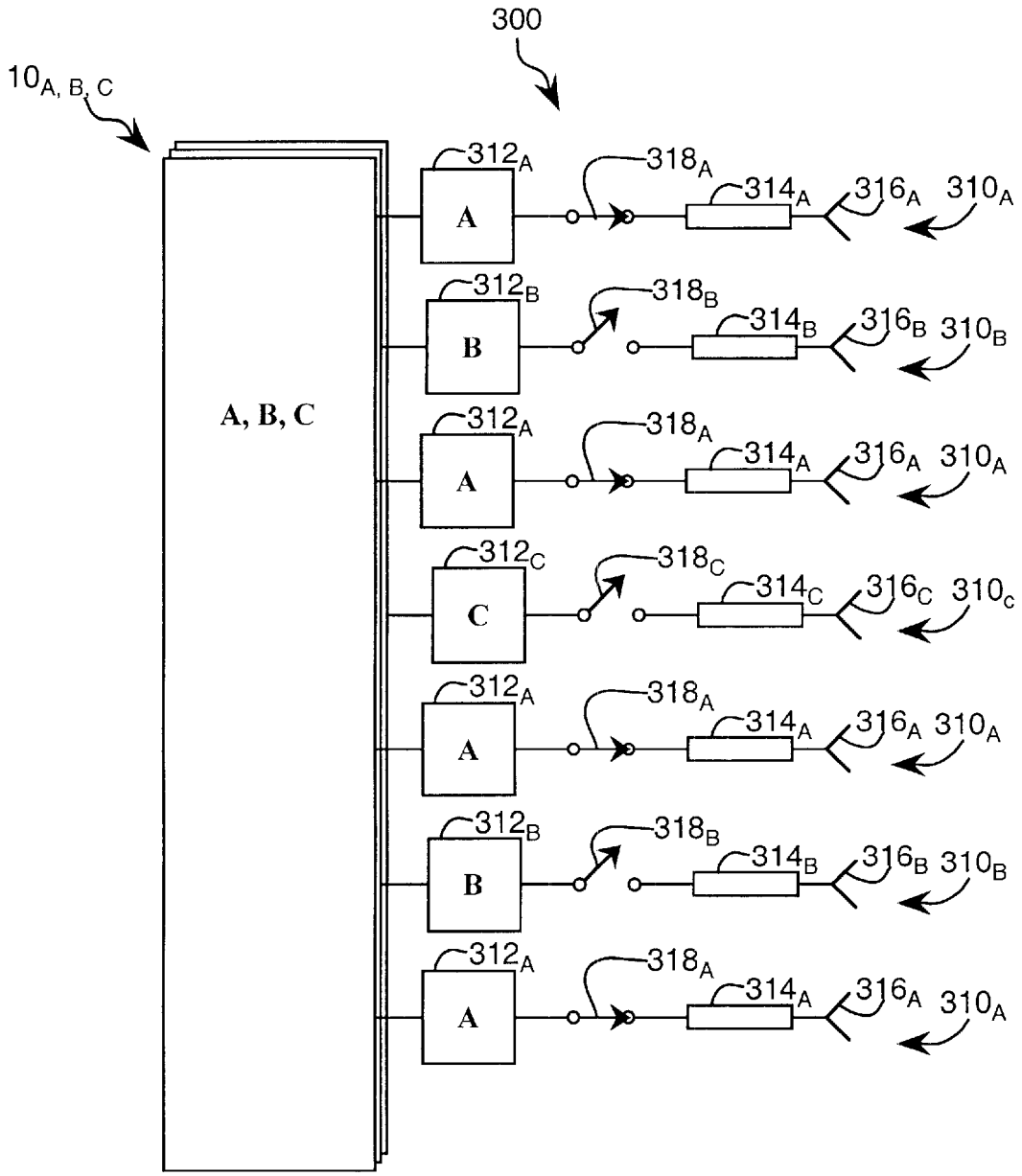
FIG. 3 (Prior Art)
FIG. 3 (prior art) shows a simplified block diagram of a multiple function, multiple band phased array antenna using interleaved radiating elements.
Figure 4:
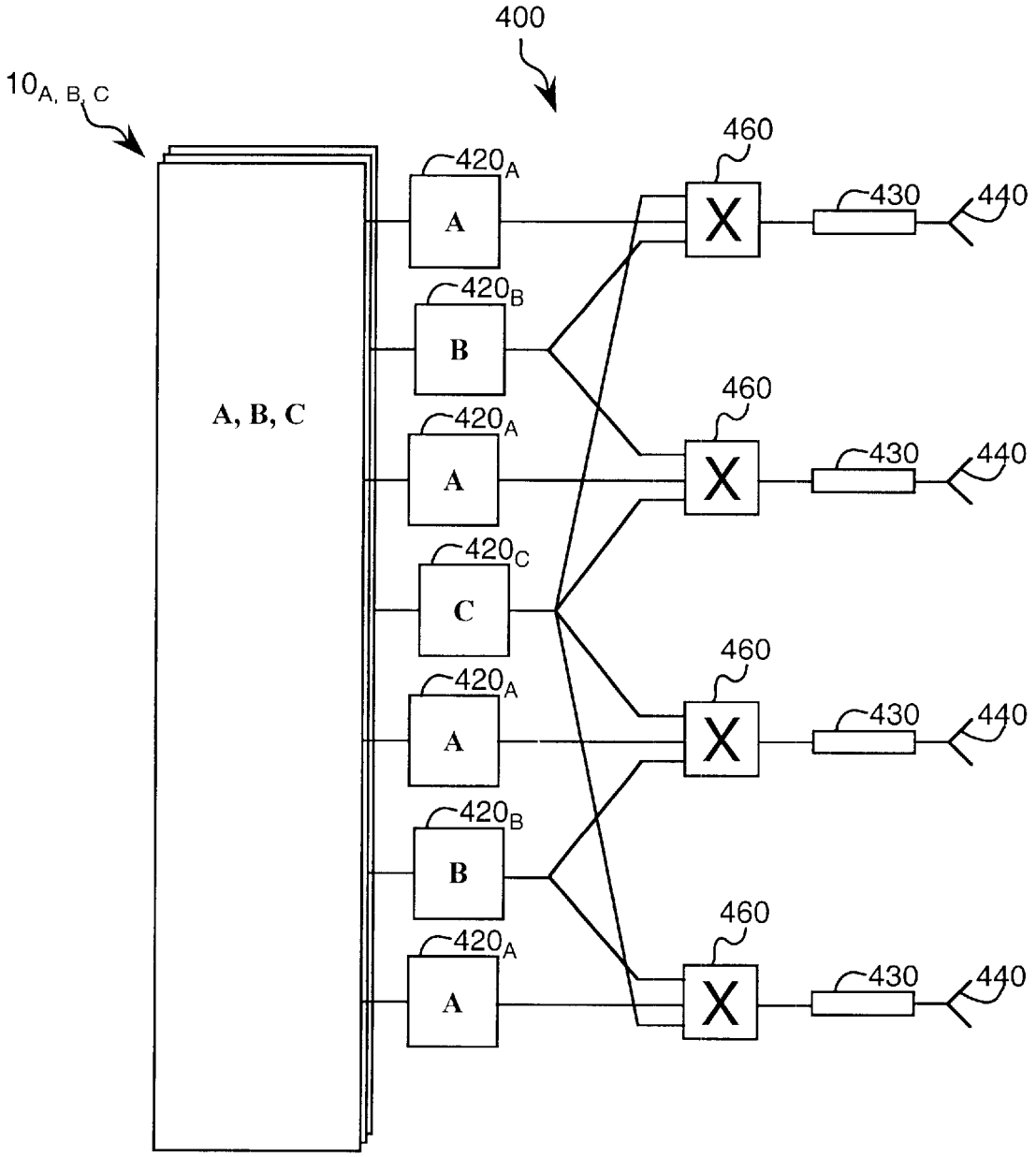
FIG. 4 (Prior Art)
FIG. 4 (prior art) shows a simplified block diagram of a multiple function, multiple band phased array antenna in which the radiating elements are reused by different functions.
Figure 5:
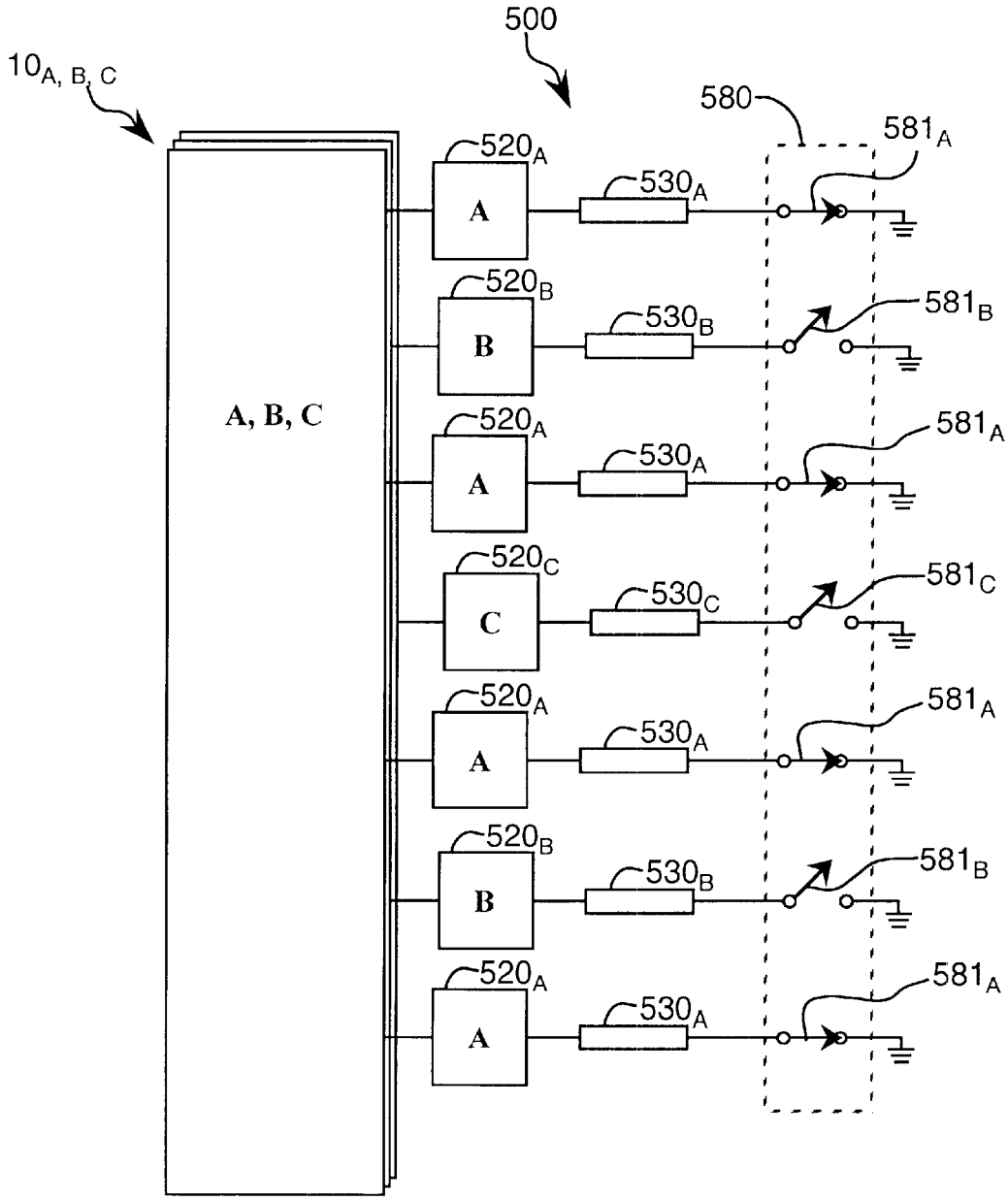
FIG. 5 shows a simplified block diagram of a multiple function, multiple band phased array antenna according to the present invention.

FIG. 5 shows a simplified block diagram of a multiple function, multiple frequency band phased array antenna 500 according to the present invention which, as an example, supports three transmit or receive functions $10_{A,B,C}$. In FIG. 5, hardware providing the transmit or receive functions $10_{A,B,C}$ is coupled to radiating control elements $520_{A,B,C}$ which control RF energy coupled via transmission lines $530_{A,B,C}$ to switches $581_{A,B,C}$ deployed directly within an RF aperture 580. FIG. 5 illustrates three transmit or receive functions using the 4:2:1 array thinning previously described and depicted in FIGS. 2 and 3. However, phased array antennas according to the present invention may accommodate one or more transmit and/or receive functions and any variation of array thinning or no array thinning at all.

Preferably, the switches $581_{A,B,C}$ are radio frequency micro electro-mechanical systems (RF MEMS) switches. RF MEMS switches provide significant advantages over other types of switches in this application. Diode switches exhibit significant losses at microwave and millimeter wave frequencies. An RF MEMS switch is smaller than any state of the art metal contacting relay, and will easily fit within RF apertures sized for millimeter and microwave frequencies. Direct switching within the aperture leaves id adjacent, unused transmit or receive paths very well isolated, such that they comprise almost ideal open circuits. Such isolation provides very little spurious reactance over extremely wide frequencies of operation. Switching unused feeds within the aperture (instead of further away and behind the transmission feeds as described above and shown in FIG. 3 ) also allows the present invention to provide transmit and receive capabilities for several separate functions that are closely spaced in frequency.

Preferably, the RF aperture 580 comprises a long narrow non-resonant-radiating slot. The non-resonate radiating slot should have a length of at least multiple wavelengths of the lowest operating frequency of RF signals to be radiated by the slot. With the slots sufficiently long, TEM radiation can occur over very large bandwidths. The slot may be shared by transmit and receive functions over at least a 10 to 1 operating bandwidth. In the description below, the periodically excited non-resonant slot has an extremely wide bandwidth of at least 10:1. A phased array antenna according to the present invention will preferably comprise multiple slots. The slots are latticed in a large array in both horizontal and vertical directions to achieve increased beam control and resolution.

The array may comprise a single array of multiple slots, where all the slots have the same longitudinal orientation, that is, the slots are arranged so that the long dimension of the slots are all parallel to each other. The array may also comprise a group of subarrays, where the slots in each subarray are oriented the same, but the slot orientation from subarray to subarray may differ. Additionally, a radome (not shown in FIG. 5) may be used to cover the aperture. The radome may be constructed such that the radiation of the apertures 580 is directed into a front hemispherical coverage. The radome may also be used to protect the switches $581_{A,B,C}$ hermetically, if desired.

The aperture 580 is excited by shunt probes, which in turn are activated by RF MEMS switches $581_{A,B,C}$ coupled to RF transmission lines $530_{A,B,C}$. In the case of a slot aperture, the shunt probe is essentially an RF connection across the slot to ground, so the RF MEMS switch, when in the closed position, acts as the shunt probe. When the RF MEMS switch is open, any RF energy applied to the switch is isolated from the slot and is not radiated by the slot.

For effective antenna beam control, the probes that are radiating a specific signal are preferably spaced close enough together so that no grating lobes will be generated at the highest frequency at which the signal is to be radiated. If multiple sets of probes are configured to radiate independent signals or independent transmit/receive functions, the probes in each set should be spaced close enough together to avoid the creation of grating lobes. For example, FIG. 5 shows a first set of radiating control elements $520_A$ coupled to transmission lines $530_A$ and switches $581_A$ within the aperture 580. A second set of radiating control elements $520_B$ and a third set $520_C$ are likewise coupled to the same aperture 580, in which the antenna is reconfigured by activating the embedded RF MEMS switches $581_{B\ or\ 581C}$, respectively, thereby activating the independent functions. The small size of the RF MEMS switches easily allows the switches for each group to be spaced closely enough together to avoid grating lobes. Additionally, the small size of the switches allows the switches for multiple independent functions to all be spaced closely enough together to avoid grating lobes for all the functions.

Figure 6:
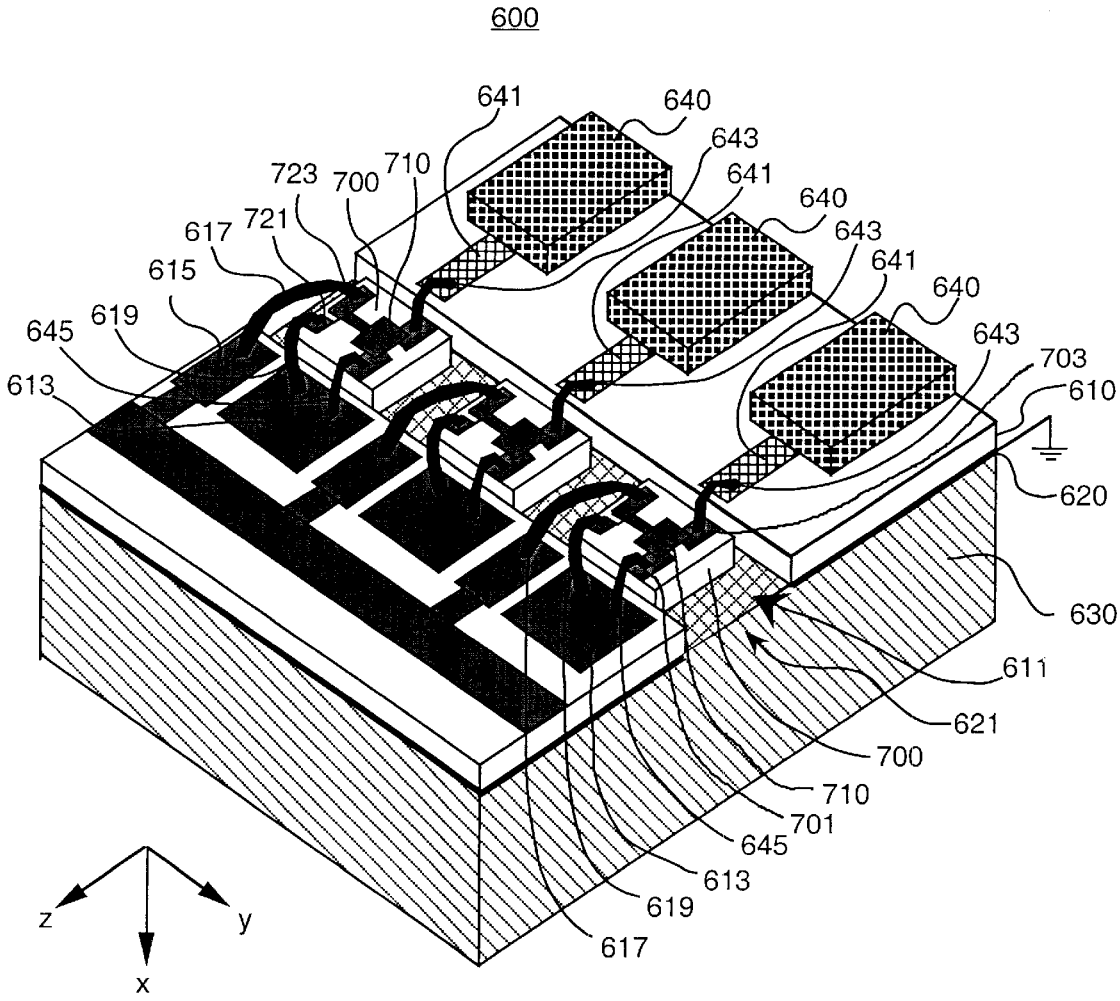
FIG. 6 shows an antenna cell according to one embodiment of the present invention showing three RF MEMS switches deployed within a slot.

FIG. 6 shows a physical realization of an exemplary antenna cell 600 according to the present invention. As described above, an indefinite number of these cells 600 would be latticed in a large array. In FIG. 6, a substrate 610 is positioned atop a ground plane 620 in which radiating slots 621 have been formed. The ground plane 620 may be positioned atop a radome 630. A substrate slot 611 is also formed in the substrate 610, which corresponds to the radiating slot 621 in the ground plane 620 beneath the substrate 610. The substrate 610 is typically only a fraction of a wavelength thick. RF MEMS switches 700 are positioned within the substrate slot 611.

The radiating slot 621 is a long non-resonant TEM slot. Therefore, the width of the radiating slot 621 and the corresponding substrate slot 611 should be wide enough to accommodate the RF MEMS switch 700, but as narrow as possible. The total length of the radiating slot 621 should be long enough to support the lowest operating frequency of the RF signals to be sent or received by the antenna cell 600. The RF MEMS switches 700 within the antenna cell 600 should be positioned apart much less than ½ the wavelength of the highest operating wavelength of the antenna cell 600 and are preferably positioned apart less than 1/10 the wavelength of the smallest operating wavelength.

The ground plane 620 may comprise a metal plate with multiple slots punched, cut, or otherwise provided in the plate. The ground plane 620 may also comprise a metal layer deposited on top of the radome 630 or on the underside of the substrate 610 using techniques known in the art, such as vacuum deposition. The metal used in the ground plane 620 comprises metals typically used for ground plane conduction, such as gold, copper, or aluminum. However, if the weight of the array is a concern, aluminum may be preferable.

The substrate 610 typically comprises a high dielectric, low loss material. Such materials include alumina/polymer hybrids, epoxy-filled substrates with alumina powder, and other microwave substrates known in the art. If the array structure is fabricated monolithically using semiconductor fabrication techniques, the substrate 610 may comprise semiconductor materials such as silicon or gallium-arsenide. The radome 630 comprises similar material, although the radome 630 preferably comprises multiple layers of different materials, as discussed below. Typical materials used in the fabrication of the substrate and radome are available from Rogers Corporation Microwave Materials Division of Chandler, Ariz.

RF energy is supplied to each RF MEMS switch 700 by an RF port 640. This port 640 may comprise simply a connection to an RF energy source, or may comprise an active device that provides control over the RF energy coupled into and out of the device. The three RF ports 640 depicted in FIG. 6 may be coupled to the same transmit or receive function, or may be coupled to separate functions to allow for interleaving of functions with the cell 600. Transmission lines 641 couple the RF MEMS switches 700 to the RF ports 640. The transmission lines may comprise microstrips positioned directly on the substrate 610. The transmission lines 641 may also have an impedance of 50 ohms, to provide for connection to standard devices. Preferably, the transmission lines 641 within a cell are spaced apart at much less than ½ wavelength of the highest desired operating wavelength of the cell 600 to minimize coupling effects.

An RF contact 710 in each RF MEMS switch 700, traversing in the z direction across the substrate slot 611, causes radiation coupling across the radiating slot 621 when energized to contact an input RF line 703 and an output RF line 701. An RF connection 643 connects the transmission line 641 to the RF input line 703. The RF connection 643 may comprise a wirebond, or other connection means known in the art. On the opposite side of the substrate slot 611 is a ground pad 613, which connects to the RF output line 701 via a ground connection 645. The ground connection 645 may also comprise a wirebond. The ground pad 613 is connected to the ground plane 620 by a via (not shown in FIG. 6) in the x direction. The RF MEMS switch 700, when closed, connects the transmission line 641 to the ground pad 613, and thus to the ground plane 620. The closure of the switch 700 therefore results in RF energy being coupled across the radiating slot 621 and radiated by the radiating slot 621.

The actuation of the RF MEMS switch 700 is controlled by a DC bias signal applied to the switch. In FIG. 6, a DC control voltage is supplied to a DC bias pad 615. A DC connection 617 connects the DC bias pad 615 to a first switch bias pad 723 on the switch 700. The DC connection 617 may also comprise a wirebond. A DC return connection 619 connects a second switch bias pad 721 to the ground pad 613. Application of a DC voltage causes the RF MEMS switch 700 to close, and thus controls the radiation of RF energy through the switch 700.

Figure 18:
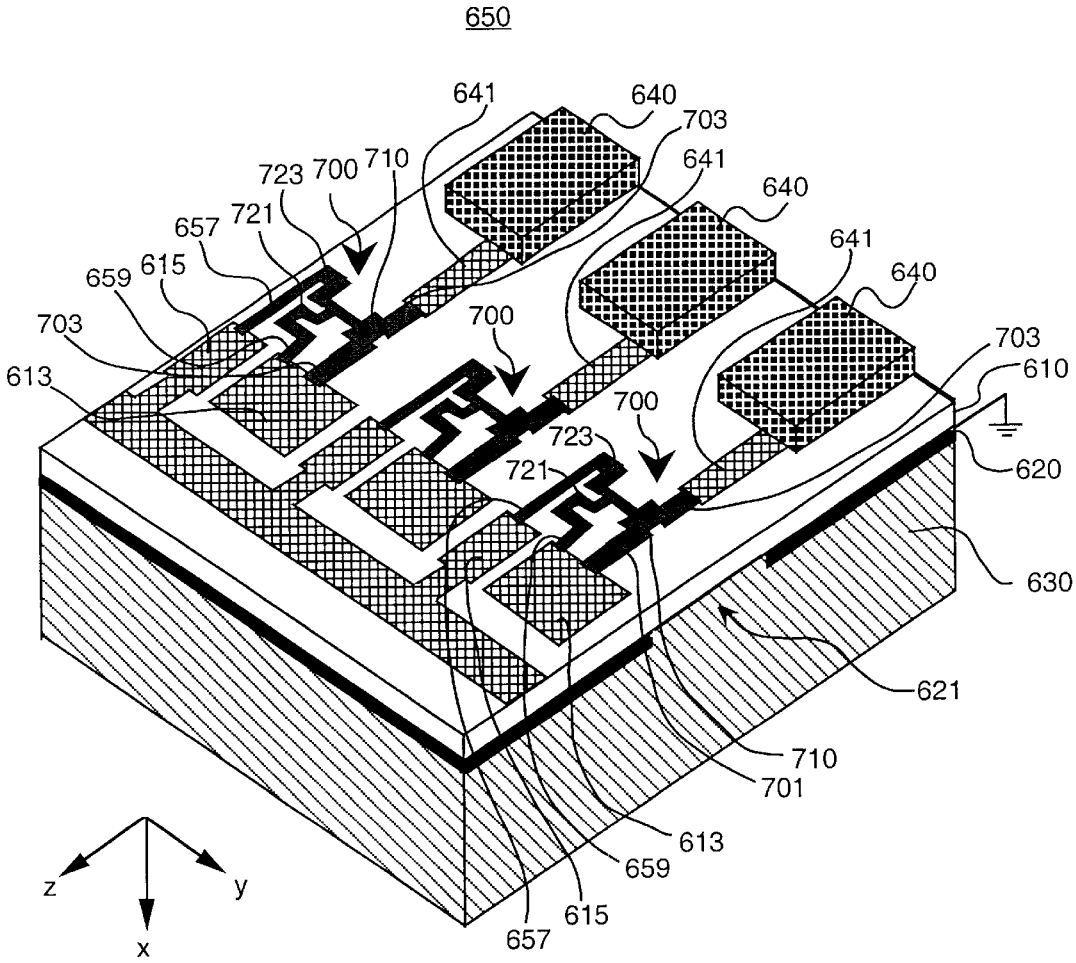
FIG. 18 shows an antenna cell according to another embodiment of the present invention showing three RF MEMS switches deployed on a substrate above a slot.

An alternative embodiment of an antenna cell 650 according to the present invention is depicted in FIG. 18. As shown in FIG. 18, the RF MEMS switches 700 may be fabricated directly on top of the substrate 610 and over the radiating slot 621 in the ground plane 620. Since the substrate is typically less than a fraction of a wavelength thick, a substrate slot 611 is not required for the coupling of RF energy from the transmission line 641 to the ground pad 613, which is connected by a via (not shown) to the ground plane 620. As described above, closure of the RF MEMS switch 700 couples RF energy from the RF port 640 to the radiating slot 621, which results in the radiation of the RF energy from the radiating slot 621.

Fabricating the RF MEMS switches 700 directly on the substrate 610 without forming a substrate slot may allow for simpler fabrication of the antenna cell 650 according to an embodiment of the present invention. In forming the antenna cell 650, both sides of the substrate 610 may initially be coated with metal. The lower side of the substrate 610 may be etched to remove metal to form radiating slots 621. The upper side of the substrate 610 may be etched to remove metal to form transmission lines 641, DC bias pads 615 and ground pads 613. The RF MEMS switches can then be fabricated directly atop the substrate 610 using MEMS fabrication techniques well-known in the art. For example, vacuum deposition may be used to deposit one or more deposited metal layers to form the DC bias connections 657 from the DC bias pads 615 to the first switch bias pads 723 and the DC ground connections 659 from the ground pads 613 to the second switch bias pad 721. Similarly, one or more metal layers may be deposited to form the input RF lines 703 and output RF lines 701.

Other embodiments of antenna arrays according to the present invention may comprise monolithic RF transmission lines, MEMS wire bonds, and DC bias lines all integrated together and fabricated using standard semiconductor fabrication techniques well known in the art. Similarly, the RF MEMS switch may also be constructed using standard semiconductor fabrication techniques well known in the art.

The closely spaced RF MEMS switches 700 that short selected RF transmission lines 641 to ground in the slot 621 enable the excitation of radiation from the slot 621 and through the radome 630. The radome 630 comprises materials with a relative high dielectric. The radome 630 ensures that the RF energy emitted from the slot 621 will propagate in the x direction, since the high dielectric of the substrate 610 will keep the energy from radiating from the other side of the slot 621. As discussed above, the radome 630 comprises layers of materials similar to that used for the substrate 610.

Figure 7A:
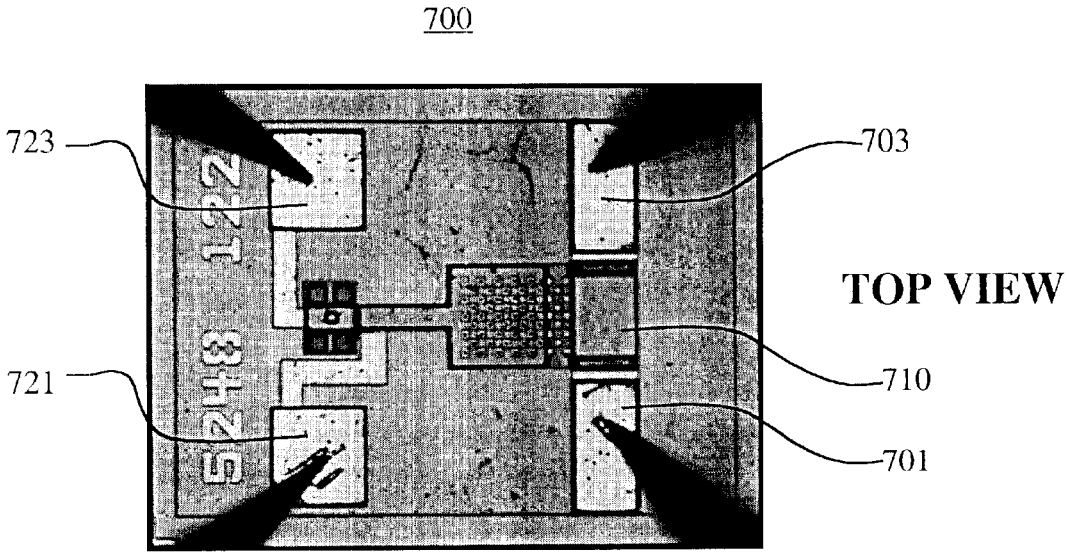
FIG. 7A depicts an exemplary RF MEMS switch for use with embodiments of the present invention.

Preferably, the RF MEMS switch 700 comprises a cantilever design such as disclosed by Loo et al. in U.S. Pat. No. 6,046,659, issued Apr. 4, 2000. A top view of an exemplary RF MEMS switch 700 is shown in FIG. 7A. In FIG. 7A, input RF energy is applied at an input RF pad 701, and RF energy is coupled out of the switch at an output RF pad 703. DC actuation pads 721, 723 provide the DC voltage required to open and close the switch 700.

Figure 7B:
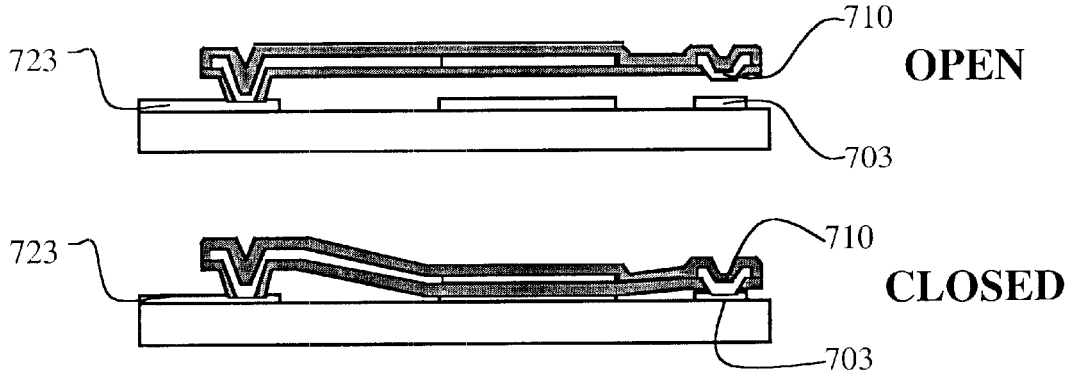
FIG. 7B shows a side view of the open and closed positions of the RF MEMS switch depicted in FIG. 7A.

A side-view schematic illustration of both the open and closed configurations of the exemplary RF MEMS switch 700 is shown in FIG. 7B. The cantilevered structure carries the RF contact 710 that provides for metal to metal contact between the input RF line 701 and the output RF line 703. The RF signal path is perpendicular to the length of the cantilever. Cantilever RF MEMS switches are preferable in the present invention due to the extremely low insertion loss and high isolation over an ultra-wide bandwidth. These switches also require extremely low power to actuate the switch. However, other switches known in the art may also be used to provide RF shorting within the slot. The switches may be provided as separate elements positioned within the slot, or may be integrally formed with the substrate and slot.

Figure 16:
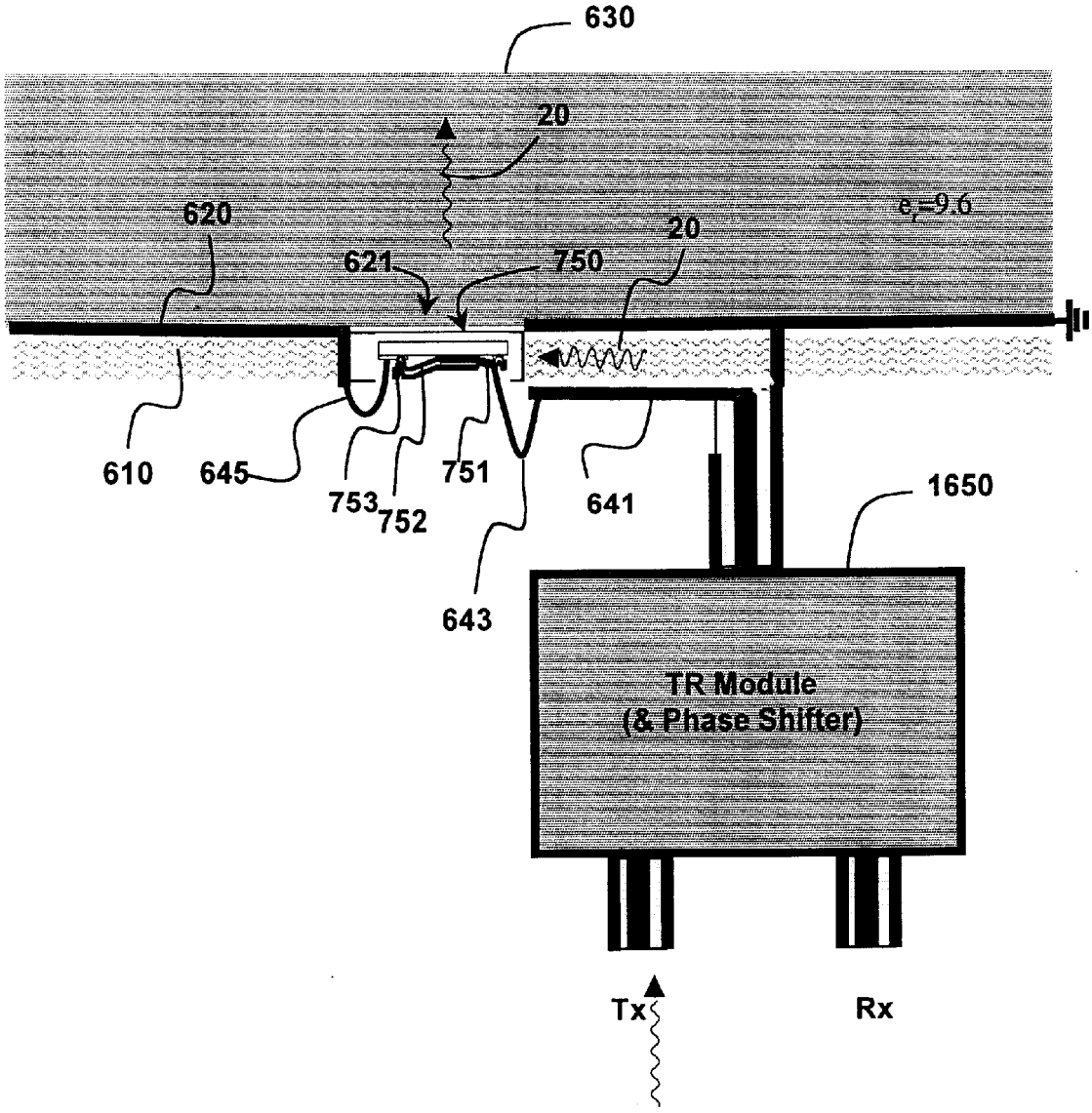
FIG. 16 shows an embodiment of the present invention using an alternative RF MEMS switch to switch RF radiation to a slotted aperture.

FIG. 16 shows an alternative RF MEMS switch 750 used to couple RF energy 20 to the radiating slot 621. A T/R module 1650 serves as the source (and destination) of RF energy and is coupled to the RF MEMS switch 750 via a transmission line 641, as described above. In the RF MEMS switch 750 depicted in FIG. 16, an RF connection 643 is made to the base of the cantilever structure 751. When the switch is activated, the RF energy 20 travels through the cantilever arm 752 and is output at an output line 753. The RF energy 20 is then coupled to the ground plane 620 via a ground connection 645. Coupling the RF energy to ground across the slot again results in RF energy being radiated is a direction generally perpendicular to the slot. Other types of RF MEMS switches known in the art may also be used with the present invention, along with other types of switches small enough to be deployed within the slot aperture.

Figure 8A:
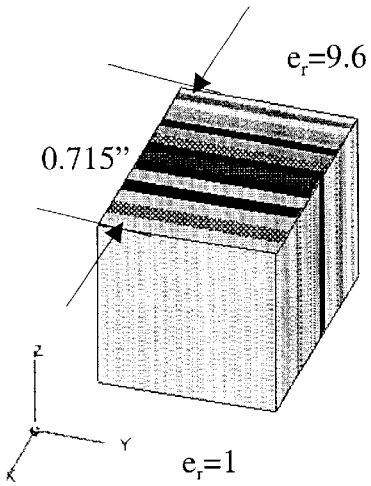
FIG. 8A depicts a multiple layer radome structure used to match the impedance of the antenna array top free space.
Figure 8B:
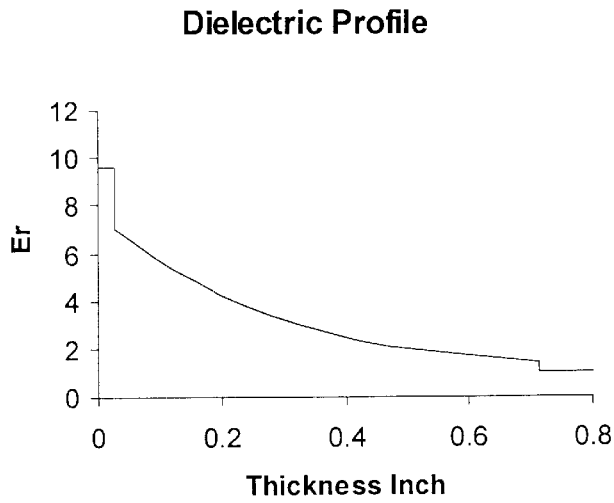
FIG. 8B shows the dielectric profile of the multiple layer structure shown in FIG. 8A.
Figure 8C:
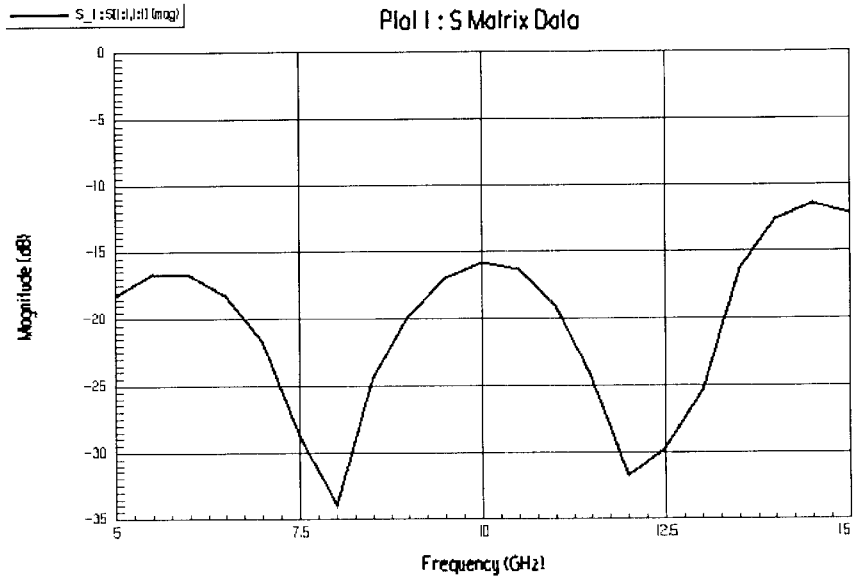
FIG. 8C shows the loss induced over a frequency range of 5 GHz to 15 GHz of the radome structure depicted in FIG. 8A.

The radome 630 covering the slot 621, as shown in FIG. 6, can be matched to free space by methods well known in the art. FIG. 8A illustrates one example of matching a relative dielectric of 9.6 to free space using several intermediate layers. One method for determining the dielectric layers required to achieve the desired impedance matching is disclosed by R. W. Klopfenstein in "A Transmission Line Taper Of Improved Design," Proce. IRE, January 1956, pp. 31–35. FIG. 8B shows the variation in dielectric profiled achieved with the layered structure depicted in FIG. 8A. FIG. 8C shows that the reflection realized by the layered radome depicted in FIG. 8A is less than—15 dB over the 10:1 band from 5 GHz to 15 GHz. This radome design allows high efficiency for the radiation through the multiple layer dielectric medium attached to the substrate, while being shielded from the RF circuitry.

Figure 9A:
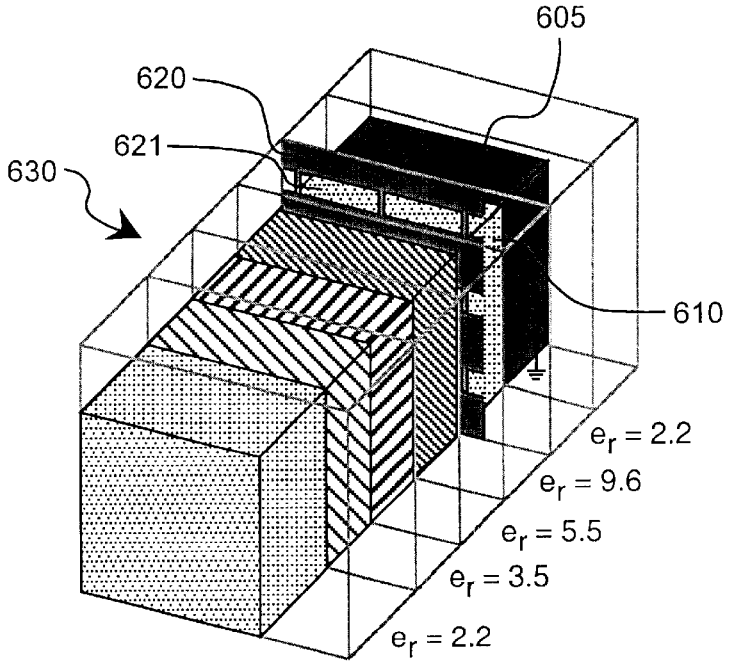
FIG. 9A shows a four layer radome structure used to match the impedance of the antenna array to free space.
Figure 9B:
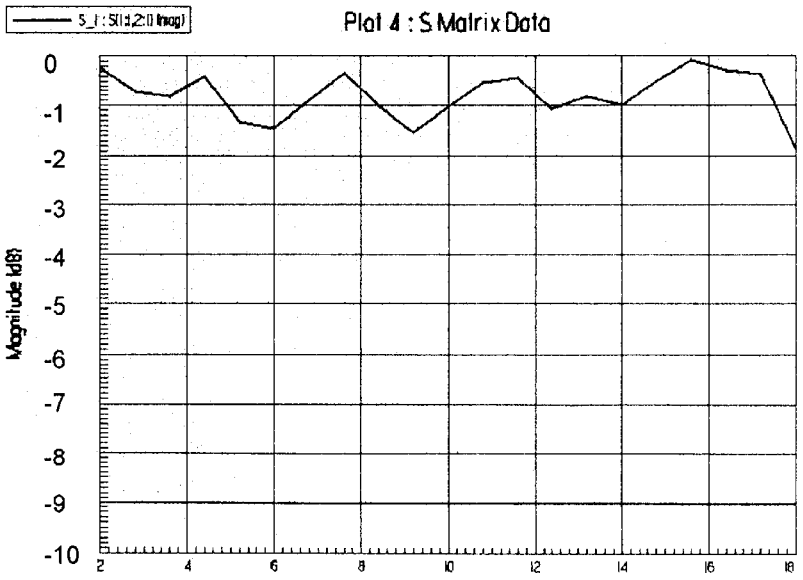
FIG. 9B shows the transmission efficiency of an embodiment of the present invention that utilizes the radome structure shown in FIG. 9A.

FIG. 9A shows an embodiment of the present invention where a four layer radome 630 is disposed in front of the ground plane 620 containing the antenna slots 621. The radome 630 comprises four different materials each having a different dielectric constant $e_r$ to match the impedance of the slotted aperture 620 to free space. This embodiment also shows an absorber used to absorb any backward traveling radiation. Typically, the absorber comprises a metalized back plane. FIG. 9B shows the transmit efficiency of a reconfigurable antenna array using this combination of a four layer radome 630, slotted ground plane 620, substrate 610, and absorber 605. As can be seen from FIG. 9B, transmit losses are less than 2 dB over the extremely wide frequency range of 2 to 18 GHz.

The intended bandwidth for the antenna array is one factor used in determining the number of layers and the widths of the layers. If the antenna is to support a wide bandwidth, there will be more layers and the layers will be thicker. If the antenna is to support a narrower bandwidth, there will be fewer layers in the radome and the layers will be thinner. Preferably, the top layer of the radome, that is, the layer of the radome in contact with free space, comprises Teflon®, so that a good dielectric match to free space is obtained.

Figure 10:
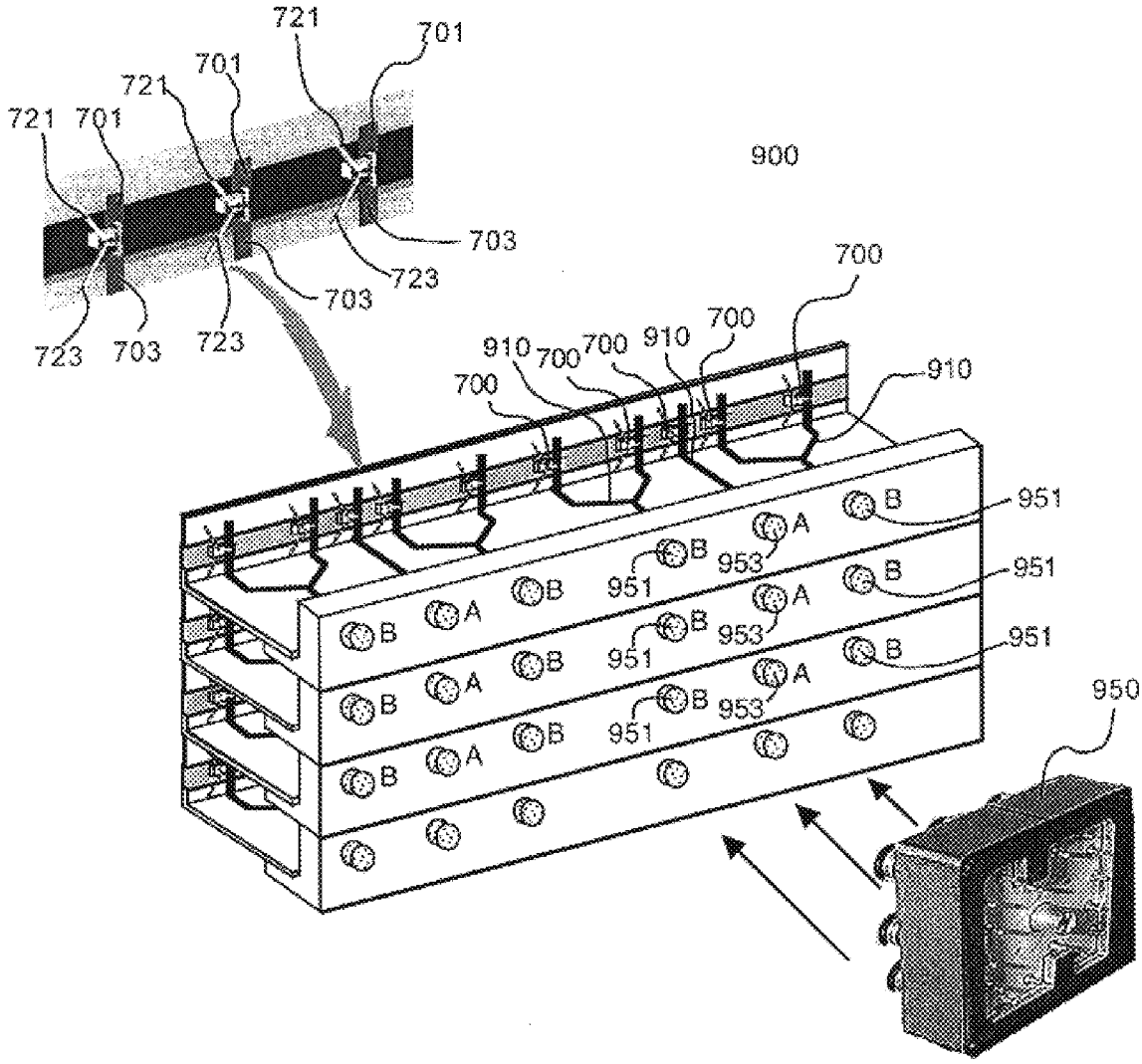
FIG. 10 shows a two channel embodiment of the present invention coupled with a two channel transmit/receive module.

FIG. 10 shows an antenna array 900 according to the present invention coupled to a dual channel transmit/receive (T/R) module 950. The T/R module 950 provides two channels, A and B, which support two different functions. An exemplary multiple channel T/R module is briefly discussed in "A Low Profile X-Band Active Phased Array For Submarine Satellite Communications," IEEE International Conference on Phased Array Systems and Technology, 2000. The T/R module 950 may be connected to the antenna array 900 via standard GPO coaxial connectors 951, 953. The feed spacing between the A and B channels on the T/R module 950 is 20% of the highest operating wavelength of the system, which allows the T/R module 950 to be deployed directly on the antenna array 900. The T/R module 950 also contains connectors that allow the T/R module to feed multiple slots in parallel.

In FIG. 10, feed lines 910 couple the T/R module 950 channels to the RF MEMS switches 700 within the array 900. The lattice spacing of the RF MEMS switches 700 connected to channel A is such that individual phasing of the RF energy coupled to the switches 700 will result in grating lobe-free beam scanning in the front hemisphere for low band frequencies. The lattice spacing used for channel B is four times as dense, and therefore supports grating lobe-free beam scanning at frequencies higher than those used with channel A. The array depicted in FIG. 10 also shows the use of array thinning, where channel A uses only one-quarter the number of radiators that are used for channel B. Hence, the feedlines 910 used for channel B signals actually connect to two RF MEMS switches 700, while the feedlines used for channel A signal only connect to a single RF MEMS switch. Note also that FIG. 10 shows the DC connection to the RF MEMS switch supplied from one side of the slot while the DC return connection is supplied from the other side of the slot. The DC connection and DC return connection may also be supplied from the same side of the slot as shown in FIG. 6 and described above.

Prior art antenna arrays that use the dual channel T/R module described above are effectively limited to support the same transmit or receive function with both channels, due to the narrow band limitations (of about 30%) of those prior art antenna arrays. However, reconfigurable antenna arrays according to the present invention can truly exploit the dual channel features of the T/R module, since such reconfigurable antenna arrays provide a usable system bandwidth that extends over a 10:1 frequency range.

A two-channel embodiment of an antenna array according to the present invention has been modeled with a first channel C of switches spaced 0.225 inches (0.57 cm) apart and a second lattice D of switches spaced 0.45 (1.14 cm) inches apart. Performance of a unit cell according to the present invention was modeled in an infinite broadside excited array. The array model assumes several of these cells latticed in two dimensions, with each cell acting collectively to produce a far field beam related to the overall desired functional properties of the first channel C or the second channel D, depending upon the states of the RF MEMS switches. Results of the model are presented in FIGS. 11–14.

Figure 11:
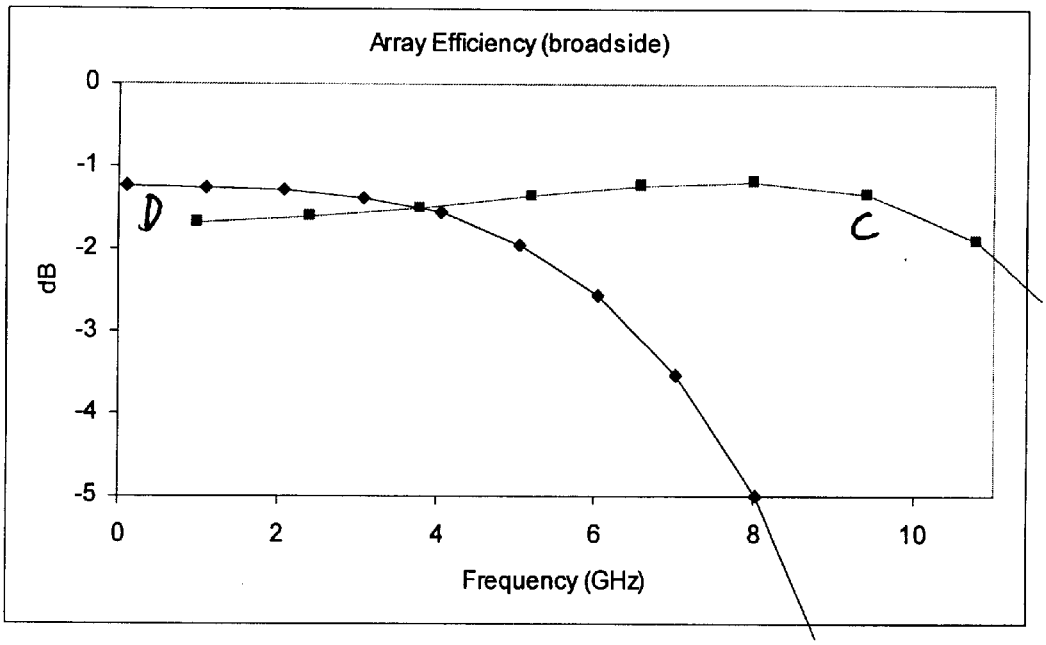
FIG. 11 shows the computed array efficiency of a two channel array with a first lattice spacing of 0.225 inches (0.57 cm) and a second lattice spacing of 0.45 inches (1.14 cm).

In FIG. 11, the computed radiation efficiency of the far field beam scanned for the broadside case at the two operating frequencies serving the low band function D and the high band function C is shown. The radiation efficiency remains between −1 dB and −2 dB over the frequencies of interest for those functions.

Figure 12:
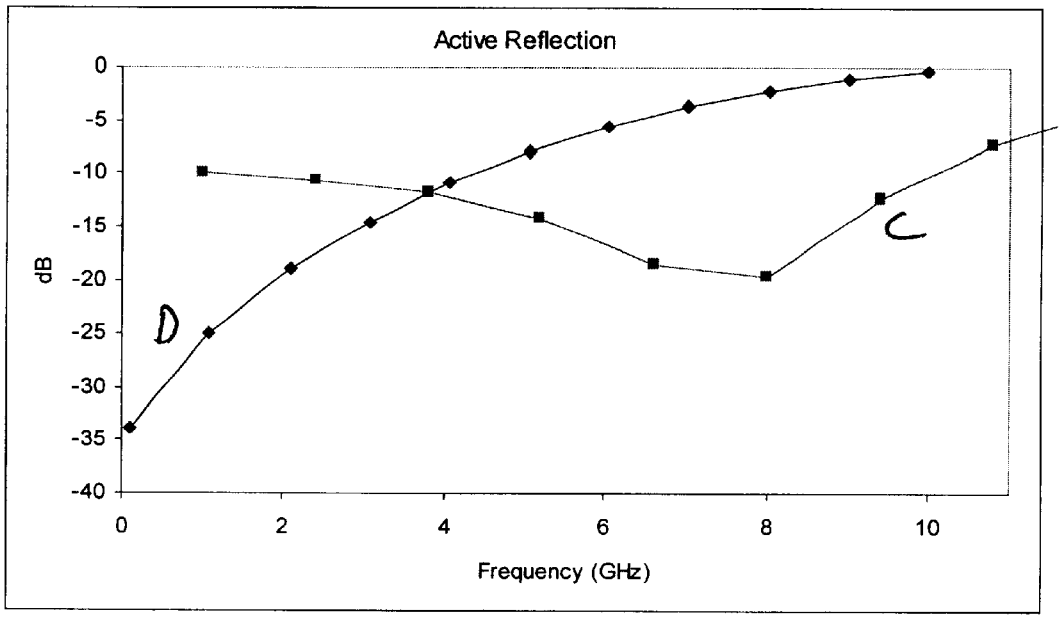
FIG. 12 shows the computed active input reflection a two channel array with a first lattice spacing of 0.225 inches (0.57 cm) and a second lattice spacing of 0.45 inches (1.14 cm).

In FIG. 12, the computed active input reflection seen at RF ports providing RF energy to the RF MEMS switches is shown for the two functions. The input reflection is less than −10 dB over the frequencies of interest. The active reflection is computed based on modeling the mutual coupling as coming from an infinite series of cells latticed in the array.

Figure 13:
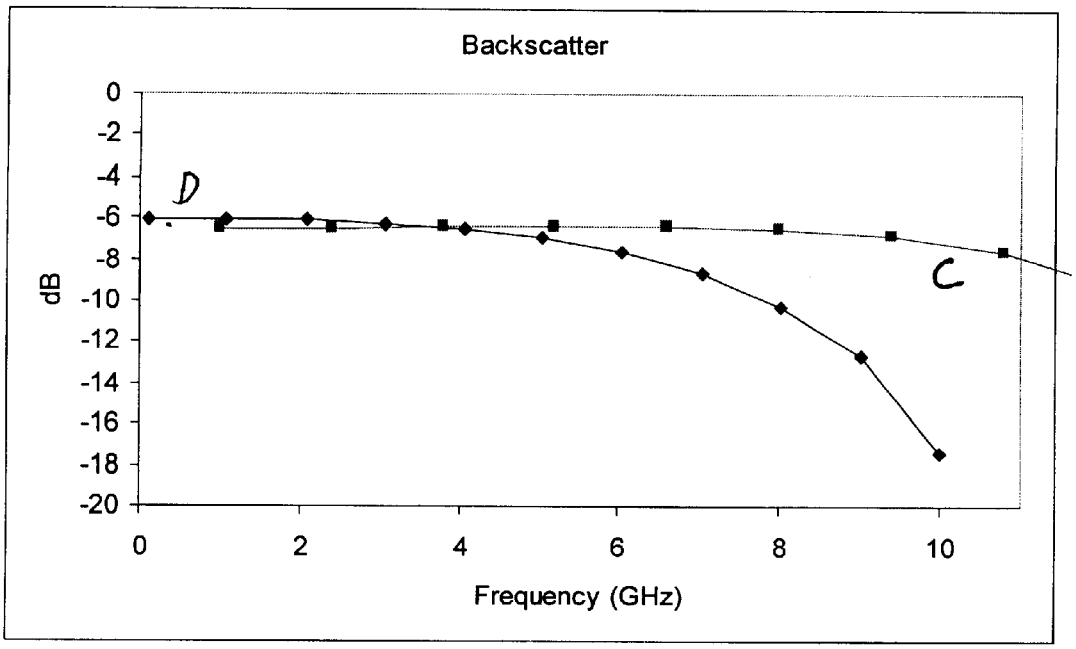
FIG. 13 shows the computed back-scatter radiation a two channel array with a first lattice spacing of 0.225 inches (0.57 cm) and a second lattice spacing of 0.45 inches (1.14 cm).

FIG. 13 shows the computed back-scatter radiation (at 180 degrees from the main broadside beam) for the two functions. The back-scatter represents a main component of lost energy and in turn contributes to the efficiency loss. The back-scatter loss may be further reduced by appropriate choices of slot gap, dielectric constant, and feed impedance optimization. FIG. 13 shows that an antenna array according to the present invention provides respectable performance over an extremely wide band, wherein such performance is difficult to obtain in other antenna array designs.

Figure 14:
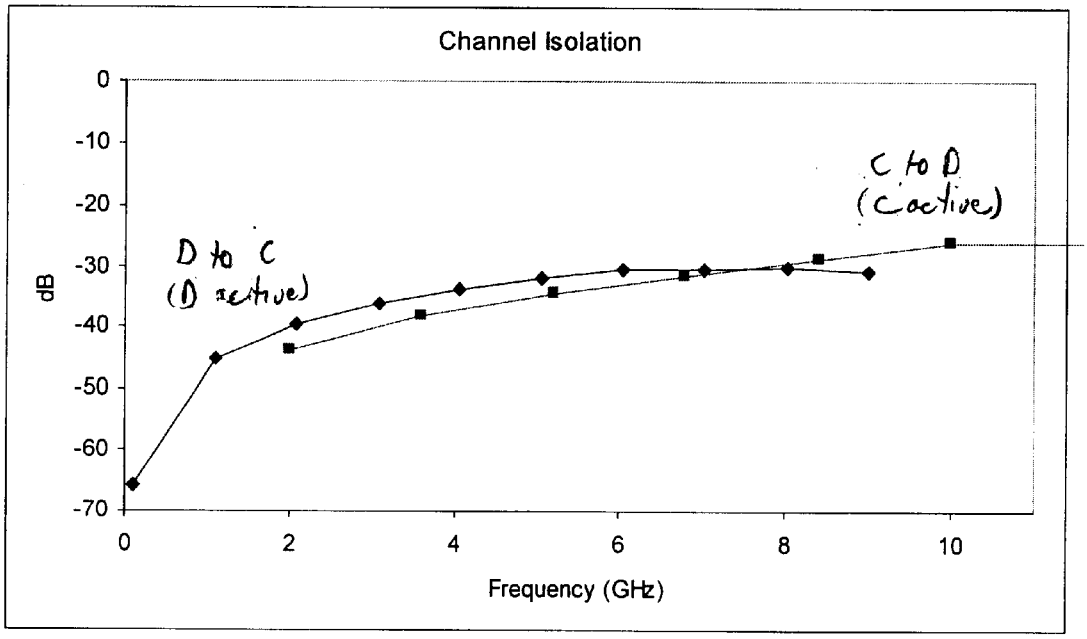
FIG. 14 shows the computer isolation between the two channels of a two channel array with a first lattice spacing of 0.225 inches (0.57 cm) and a second lattice spacing of 0.45 inches (1.14 cm).

FIG. 14 show the computed isolation between adjacent channels, with either function C or function D active. As shown, the isolation is greater than 30 dB over the frequencies of interest.

Figure 15:
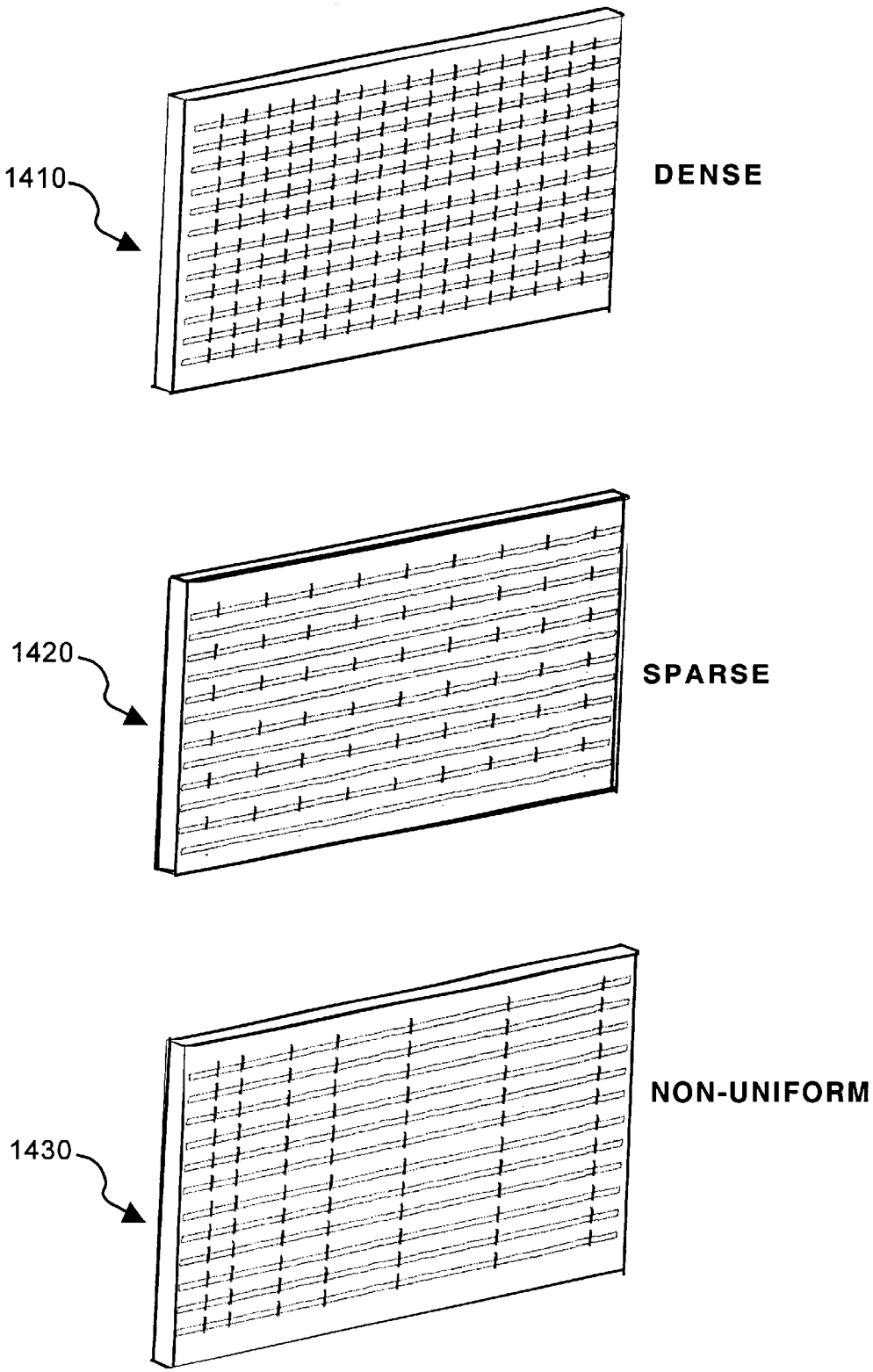
FIG. 15 depicts alternative array densities provided by embodiment of the present invention.

The present invention provides the ability to reconfigure an antenna array for different scenarios. FIG. 15 illustrates some examples of the different scenarios. As described above, RF MEMS 700 switches can be deployed within the apertures of an antenna array 1410 and controlled such that an extremely dense lattice of radiating elements is achieved. A dense lattice provides the ability to avoid grating lobes over a wide volume of antenna scan. The RF MEMS switches can then be controlled within an antenna array 1420 to provide a sparse lattice for low frequencies. Controlling the RF MEMS switches so that fewer are closed results in a thinned array that reduces the number of T/R modules required to excite the array at the lower frequency. The RF MEMS switches can also be controlled to provide an antenna array 1430 with a non-uniform lattice. Control of the RF MEMS switches in this manner provides the ability for additional beam control so that flat top, cosecant, and other shapes of antenna beams can be realized. Different shapes of antenna beams can also be obtained with uniform lattices, but the non-uniform lattice capability provided by the present invention provides an extra degree of freedom in forming such antenna beams, thus providing increased performance. The RF MEMS switches can also be controlled so as to lower the sidelobes of antenna beams or to implement adaptive nulling within the beams.

Figure 17:
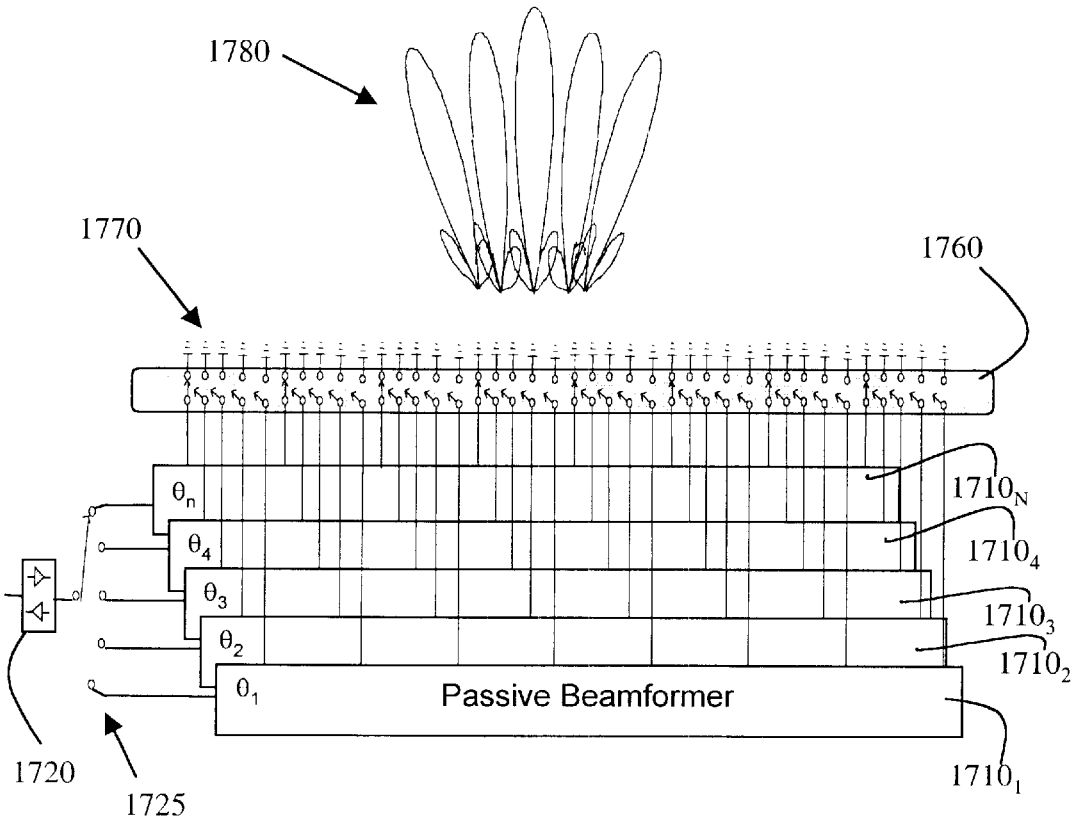
FIG. 17 shows an embodiment of the present invention used to provide discrete angle antenna beam steering.

The present invention also provides the ability to achieve coarse antenna beam scanning with fewer phase shifters than required in the prior art. As shown in FIG. 17, an RF device 1720, such as a T/R module, may connected to an array of passive beamformers $\mathbf{1710}_1 \ldots \mathbf{1710}_N$ through a switch 1725 which selects one of the beamformers $\mathbf{1710}_1 \ldots \mathbf{1710}_N$. Different phase delays required to steer the antenna beam to specific directions are hardwired in each passive beamformer. Each passive beamformer is then coupled to a different set of RF MEMS switches 1770 deployed within the apertures 1760 of an array. The small size of the RF MEMS switches allows them to be placed within much less than 0.1 wavelengths of each other, or, for purposes of RF radiation, essentially at the same places within the aperture. The RF device 1720 is switched to a particular beamformer $\mathbf{1710}_1 \ldots \mathbf{1710}_N$ via the RF switch 1725 and the RF MEMS switches 1770 associated with that beamformer $\mathbf{1710}_1 \ldots \mathbf{1710}_N$ are activated to select a particular antenna beam 1780. If another antenna beam 1780 is desired, a separate beamformer $\mathbf{1710}_1 \ldots \mathbf{1710}_N$ is selected and the corresponding switches 1770 activated. Coarse beam scanning provided by this embodiment of the present invention allows for multiple discrete beams to be created, at a lower cost than required with conventional active arrays which may require phase shifters at each radiating element.

FIG. 17 also illustrates an additional embodiment of the present invention where additional RF switching, upstream from the switches 1770 in the apertures 1760, is used to provide additional control over the RF radiation transmitted and received by the array. As shown in FIG. 17, a single T/R module 1720 may be switched to any number of aperture switches 1770, which are then switched to obtain the desired antenna beam pattern. This multiple switching capability provides increased ability for interleaving multiple functions in a single antenna array and reconfiguring the antenna array to obtain optimal antenna beams for those different functions.

From the foregoing description, it will be apparent that the present invention has a number of advantages, some of which have been described above, and others of which are inherent in the embodiments of the invention described above. Also, it will be understood that modifications can be made to the reconfigurable interleaved phased array antenna described above without departing from the teachings of subject matter described herein. As such, the invention is not to be limited to the described embodiments except as required by the appended claims.

What is claimed is:

1. An array antenna for radiating RF energy comprising:

a plurality of non-resonant slot apertures, each non-resonant slot aperture having a first side and a second side and an opening between the first side and the second side;

a plurality of antenna feeds, one or more antenna feeds of the plurality of antenna feeds located on the first side or the second side of each non-resonant slot aperture;

a plurality of switches deployed immediately adjacent to the each one of the plurality of non-resonant slot apertures, each switch of the plurality of switches connected to at least one antenna feed and controllable to selectively couple RF energy from at least one antenna feed located on one side of an adjacent slot aperture across the opening of the adjacent non-resonant slot aperture to the other side of the adjacent non-resonant slot aperture.

2. An array antenna according to claim 1, wherein the plurality of switches comprises a plurality of RF MEMS switches.

3. An array antenna according to claim 2, the array antenna having a shortest operating wavelength and a longest operating wavelength and wherein the plurality of non-resonant slot apertures comprises:

a metal layer having an upper side and a lower side and having one or more slots, each slot comprising an opening in the metal layer having a length longer than the longest operating wavelength and a width less than the shortest operating wavelength; and a substrate layer having a top side and a bottom side, the substrate layer comprising substrate material disposed on the upper side of the metal layer, wherein the bottom side of the substrate layer is adjacent the metal layer and the antenna feeds are positioned on the top side of the substrate layer; and one or more vias projecting from the top side of the substrate layer to the bottom side of the substrate layer and in electrical contact with the metal layer.

4. An array antenna according to claim 3 wherein the plurality of RF MEMS switches are disposed on the substrate layer, the RF MEMS switches being positioned above the openings in the metal layer and controllable to selectively electrically connect or disconnect at least one antenna feed located on one side of the corresponding slot aperture to at least one via of the one or more vias.

5. An array antenna according to claim 3 wherein the substrate layer has a plurality of slots, each slot in the plurality of slots being positioned adjacent to and generally above the openings in the metal layer and having a length and width generally equal to the openings in the metal layer and the plurality of RF MEMS switches being disposed at or directly above the openings in the metal layer, the RF MEMS switches being controllable to selectively electrically connect or disconnect at least one antenna feed located on one side of the corresponding slot aperture to at least one via of the one or more vias.

6. An array antenna according to claim 3 further comprising a radome disposed on the lower side of the metal layer.

7. An array antenna according to claim 6 wherein the radome comprises a plurality of dielectric layers, the dielectric layers each having a dielectric constant and a width, the dielectric constant and width of each layer varying from the layer adjacent to the metal layer to a layer adjacent free space to match an impedance of the nonresonant slot apertures to an impedance of free space.

8. An array antenna according to claim 6 further comprising an absorber disposed above the top side of the substrate layer.

9. An array antenna according to claim 8 wherein the absorber comprises a metalized back plate.

10. An array antenna according to claim 2, wherein each RF MEMS switch in the plurality of RF MEMS switches comprises a cantilevered single pole single throw RF MEMS switch.

11. An array antenna according to claim 1, wherein the non-resonant slot apertures are disposed in a planar array and each non-resonant slot aperture has a longitudinal orientation, the longitudinal orientation of each slot aperture being generally parallel to the longitudinal orientation of every other slot aperture.

12. A phased array antenna according to claim 1, wherein the switches in the plurality of switches being selectively controllable to form antenna beams with different shapes.

13. A method of radiating and receiving RF energy with an antenna array having a shortest operating wavelength and a longest operating wavelength, the method comprising the steps of:

providing a plurality of non-resonant slot apertures;

providing a plurality of switches, one or more of said switches being disposed in proximity to each non-resonant slot aperture, each of said switches having a first position coupling RF energy to the aperture in proximity to the switch and having a second position isolating RF energy from the aperture in proximity to the switch;

switching a portion of the plurality of switches to the first position;

switching the remaining switches to the second position;

applying RF energy to the switches.

14. The method according to claim 13, wherein said switches are RF MEMS switches.

15. The method according to claim 14, wherein the plurality of non-resonant slot apertures comprise openings in a metal layer, the metal layer having an upper side and a lower side, and each opening having a length longer than the longest operating wavelength and a width less than the shortest operating wavelength.

16. The method according to claim 15 wherein a substrate layer is disposed on the upper side of the metal layer, the substrate layer having a top side and a bottom side, the bottom side of the substrate layer is disposed adjacent the upper side of the metal layer and the substrate layer has a plurality of electrically-conductive vias projecting from the top side of the substrate layer to the bottom side of the substrate layer, the electrically-conductive vias being in electrical contact with the metal layer.

17. The method according to claim 16 wherein the plurality of RF MEMS switches are disposed on the substrate layer, the RF MEMS switches being positioned above the openings in the metal layer and controllable to selectively couple RF energy to or isolate RF energy from the vias.

18. The method according to claim 16 wherein the substrate layer has a plurality of slots, each slot in the plurality of slots positioned generally above the openings in the metal layer and the plurality of RF MEMS switches are disposed above the openings in the metal layer, the RF MEMS switches controllable to selectively couple RF energy to or isolate RF energy from the vias.

19. The method according to claim 16 wherein the non-resonant slot apertures have an impedance and the metal layer has a radome disposed on the lower side of the metal layer, the radome comprising multiple dielectric layers, the width and dielectric constants of each dielectric layer of the multiple dielectric layers chosen to match the impedance of the non-resonant slot apertures to free space.

20. The method according to claim 16 wherein an absorber is disposed above the top side of the substrate layer, the absorber comprising a metalized back plate.

21. A beam-steered antenna array comprising:

a plurality of non-resonant slot apertures, each non-resonant slot aperture having a first side and a second side and an opening between the first side and the second side;

a plurality of groups of switches, each group of switches comprising a plurality of switches deployed immediately adjacent to the slot apertures, the switches controllable to selectively couple RF energy at different points across the opening of each non-resonant slot aperture;

a plurality of beamformers, each beamformer connected to a separate group of switches in the plurality of groups of switches; and an RF switch selectively controllable to couple RF energy to a selected one of beamformers in the plurality of beamformers.

22. A beam-steered antenna array according to claim 21 wherein said non-resonant slot apertures are arranged as a planar array.

23. A beam-steered antenna array according to claim 21 wherein each switch in said plurality of switches is an RF MEMS switch, the RF MEMS switches being deployed at different points immediately above the openings in the non-resonant slot apertures.

24. A beam-steered antenna array according to claim 21 wherein the switches are controlled to form antenna beams with selectable shapes.

25. A beam-steered antenna array according to claim 21 wherein the antenna array has a shortest operating wavelength and each switch in each group of switches is disposed within one-tenth of the shortest operating wavelength of a switch from each of the other groups of switches.

26. A method of antenna beamforming , comprising the steps of:

providing a plurality of non-resonant slot apertures in an antenna array;

providing a plurality of groups of switches, each group of switches comprising a plurality of switches deployed at different positions immediately adjacent the non-resonant slot apertures, each of said switches having a first position coupling RF energy to the aperture in proximity to the switch and having a second position isolating RF energy from the aperture in proximity to the switch;

providing a plurality of beamformers, each beamformer connected to a separate group of switches in the plurality of groups of switches;

coupling RF energy to a selected one of the beamformers in the group of beamformers;

switching the switches in the group of switches connected to the selected beamformer to either the first position or the second position; and switching the remaining switches to the second position.

27. The method of antenna beamforming according to claim 26 wherein the antenna array has a shortest operating wavelength and each switch in each group of switches is disposed within one-tenth of the shortest operating wavelength of a switch from each of the other groups of switches.

28. The method of antenna beamforming according to claim 26 wherein the switches are controlled to form antenna beams with selectable shapes.

29. A phased array antenna system having a shortest operating wavelength and a longest operating wavelength, the phased array system supporting multiple transmit/receive functions, the phased array antenna system comprising:

a plurality of transmit/receive modules, each transmit/receive module coupled to RF hardware providing one or more of the multiple transmit/receive functions, each transmit/receive module having one or more channels, each channel being coupled out of the transmit/receive module at one or more transmit/receive ports;

one or more non-resonant slot apertures, each slot aperture having a first side and a second side and an opening between the first side and the second side;

a plurality of antenna feeds, one or more antenna feeds of the plurality of antenna feeds located on a first side or a second side of a corresponding one of the slot apertures, each antenna feed coupled to one transmit/receive port of the one or more transmit/receive ports on one transmit/receive module of the plurality of transmit/receive modules; and a plurality of switches disposed immediately adjacent to the non-resonant slot apertures, each switch of the plurality of switches connected to one antenna feed and controllable to selectively couple RF energy from the antenna feed located on one side of the corresponding slot aperture across the opening of the corresponding non-resonant slot aperture to the other side of the corresponding slot aperture.

30. The phased array antenna system according to claim 29 wherein each transmit/receive port of each transmit/receive module is coupled to one or more antenna feeds and at least one of the switches deployed immediately adjacent one non-resonant slot aperture and connected to one transmit/receive port of each transmit/receive module is disposed within a distance of one-tenth of the shortest operating wavelength to at least one of the switches connected to each other transmit/receive port of the transmit/receive module and deployed immediately adjacent the same non-resonant slot aperture.

31. A phased array antenna system according to claim 30, wherein the plurality of switches comprises a plurality of RF MEMS switches and wherein the one or more non-resonant slot apertures comprises:

a metal layer having an upper side and a lower side and having one or more slots, each slot comprising an opening in the metal layer having a length longer than the longest operating wavelength and a width less than the shortest operating wavelength; and a substrate layer having a top side and a bottom side, the substrate layer comprising substrate material disposed on the upper side of the metal layer, wherein the bottom side of the substrate layer is adjacent the metal layer and the antenna feeds are positioned on the top side of the substrate layer; and one or more vias projecting from the top side of the substrate layer to the bottom side of the substrate layer and in electrical contact with the metal layer.

32. A phased array antenna system according to claim 31 wherein the plurality of RF MEMS switches are disposed on the substrate layer, the RF MEMS switches being positioned above the openings in the metal layer and controllable to selectively electrically connect or disconnect at least one antenna feed located on one side of the corresponding non-resonant slot aperture to at least one via of the one or more vias.

33. A phased array antenna system according to claim 31 wherein the substrate has a plurality of slots, each slot in the plurality of slots positioned generally above the openings in the metal layer and the plurality of RF MEMS switches are disposed above the openings in the metal layer, the RF MEMS switches controllable to selectively electrically connect or disconnect at least one antenna feed located on one side of the corresponding slot aperture to at least one via of the one or more vias.

34. A phased array antenna system according to claim 29, wherein the plurality of switches comprises a plurality of RF MEMS switches.

35. A phased array antenna system according to claim 29 further comprising a radome having a plurality of dielectric layers, the dielectric layers each having a dielectric constant and a width, the dielectric constant and width of each layer chosen to provide impedance matching between the non-resonant slot apertures and free space.

36. A phased array antenna according to claim 29, wherein the non-resonant slot apertures are disposed in a planar array and each non-resonant slot aperture has a longitudinal orientation, the longitudinal orientation of each slot aperture being generally parallel to the longitudinal orientation of every other slot aperture.

* * * * *